US005640187A

United States Patent [19]

Kashiwazaki et al.

[11] Patent Number: 5,640,187

[45] Date of Patent: Jun. 17, 1997

[54] INK JET RECORDING METHOD AND INK JET RECORDING APPARATUS THEREFOR

[75] Inventors: Akio Kashiwazaki, Yokohama; Yuko Suga, Tokyo; Aya Takaide, Yokohama, all of Japan

[73] Assignee: Canon Kabushiki Kaisha, Tokyo, Japan

[21] Appl. No.: 571,740

[22] Filed: Dec. 13, 1995

Related U.S. Application Data

[63] Continuation of Ser. No. 117,663, Sep. 8, 1993, abandoned.

[30] Foreign Application Priority Data

| | | | |
|---|---|---|---|
| Sep. 10, 1992 | [JP] | Japan | 4-242247 |
| Sep. 10, 1992 | [JP] | Japan | 4-242248 |
| Sep. 21, 1992 | [JP] | Japan | 4-251587 |

[51] Int. Cl.[6] ..... B41J 2/05

[52] U.S. Cl. ..... 347/101; 347/96

[58] Field of Search ..... 347/101, 96, 98

[56] References Cited

U.S. PATENT DOCUMENTS

| | | | |
|---|---|---|---|
| 4,538,160 | 8/1985 | Uchiyama | 347/98 |
| 4,694,302 | 9/1987 | Hackleman et al. | 347/98 |
| 4,804,411 | 2/1989 | Eida et al. | 106/22 |
| 4,887,097 | 12/1989 | Akiya et al. | 347/98 |
| 5,059,246 | 10/1991 | Yamamoto et al. | 106/22 |
| 5,074,914 | 12/1991 | Shirota et al. | 106/22 |
| 5,101,218 | 3/1992 | Sakaki et al. | 347/96 |
| 5,118,351 | 6/1992 | Shirota et al. | 106/22 |
| 5,141,558 | 8/1992 | Shirota et al. | 106/22 |
| 5,151,128 | 9/1992 | Fukushima et al. | 106/20 |
| 5,160,370 | 11/1992 | Suga et al. | 106/20 |
| 5,172,133 | 12/1992 | Suga et al. | 346/1.1 |
| 5,184,148 | 2/1993 | Suga et al. | 346/1.1 |
| 5,190,581 | 3/1993 | Fukushima et al. | 106/20 D |
| 5,220,347 | 6/1993 | Fukushima et al. | 346/1.1 |
| 5,221,333 | 6/1993 | Shirota et al. | 106/20 D |
| 5,229,786 | 7/1993 | Suga et al. | 346/1.1 |
| 5,248,991 | 9/1993 | Shirota et al. | 346/1.1 |
| 5,250,121 | 10/1993 | Yamamoto et al. | 106/22 R |
| 5,254,157 | 10/1993 | Koike et al. | 106/20 D |
| 5,258,066 | 11/1993 | Kobayashi et al. | 106/22 R |

FOREIGN PATENT DOCUMENTS

| | | |
|---|---|---|
| 56-89595 | 7/1981 | Japan . |
| 56-147859 | 11/1981 | Japan . |
| 56-147860 | 11/1981 | Japan . |
| 63-145381 | 6/1988 | Japan . |
| 63281889 | 11/1988 | Japan . |
| 64-63185 | 3/1989 | Japan . |
| 3-240557 | 10/1991 | Japan . |
| 4-57859 | 2/1992 | Japan . |
| 4-57860 | 2/1992 | Japan . |

OTHER PUBLICATIONS

Patent Abstracts of Japan, vol. 13, No. 90 (M-803) (3438) Mar. 2, 1989 for JP-A-63-281885.

*Primary Examiner*—Valerie Lund

*Attorney, Agent, or Firm*—Fitzpatrick, Cella, Harper & Scinto

[57] ABSTRACT

An ink jet recording method for performing a recording operation by discharging an ink droplet composed of an ink composition containing a pigment, a water soluble resin for dispersing the pigment and water to a recording member, on which data is recorded, the ink jet recording method comprising a step of supplying a solution containing particles and/or binder polymer on to the recording member, prior to discharging the ink. An apparatus for practicing the ink jet recording method of the present invention has a plurality of heads that discharge the ink, by supplying energy to the ink, and the solution containing particles and/or binder polymer.

33 Claims, 4 Drawing Sheets

INK JET RECORDING METHOD AND INK JET RECORDING APPARATUS THEREFOR

This application is a continuation of application Ser. No. 08/117,663, filed Sep. 8, 1993, abandoned.

BACKGROUND OF THE INVENTION

1. Field of the Invention

The present invention relates to a method and an apparatus for jetting ink droplets through a small discharge port onto a recording member to record data.

2. Description of the Prior Art

The ink jet recording method has advantages that noise generation can be prevented at the time of the recording operation and that a high-resolution recorded image can be obtained at high speed due to its highly-integrated head. The foregoing ink jet recording method has conventionally employed ink of a type prepared by dissolving a water-soluble dye selected from a variety of available dyes in water or in a mixture solution of water and a water-soluble organic solvent. However, the recorded image formed by using ink of the foregoing type frequently raises a problem of unsatisfactory fastness such as light resistance and water resistance. In particular, black images usually used in public documents and so forth must exhibit excellent fastness, and accordingly, further improved fast inks have been desired.

Accordingly a variety of investigations have been made for the purpose of preparing ink of a type in which pigment-dispersed fluid, in which a pigment is dispersed in a polymeric dispersant, is dissolved in water or in a mixture solution of water and a water-soluble solvent because excellent water resistance and light resistance can be obtained in comparison to ink of a type containing a water-soluble dye.

In Japanese Patent Laid-Open Nos. 56-147859 and 56-147860 and so forth, pigment ink prepared by using a specific water-soluble organic solvent and a polymer dispersant has been suggested. Further, ink of a type using both a pigment and a water-soluble dye has been suggested in Japanese Patent Laid-Open No. 4-57859 and 4-57860 and so forth.

However, the foregoing conventional pigment ink raises a problem in that the quality of the formed image deteriorates and the density of the same decreases depending upon the type of paper used, for example, where data is recorded on a common paper sheet (usual paper for office use such as copying paper or bond paper). Since the common paper sheet has a surface condition that is not constant, as contrasted with special paper for the ink jet printing operation, the quality of the recorded image varies due to the difference in the ink absorption characteristics of the paper surface due to bleeding. When the density of an image which determines the quality of the recorded article is considered, the surface condition of a recording member, on which data is recorded by using ink containing a water-soluble dye, does not considerably affect the density of a formed image. The reason for this is that the dye adheres to the fiber of the recording member and the dye can easily be left on the surface thereof. On the other hand, pigment ink forms an image by leaving and fixing the pigment on the surface of the recording member. Therefore, the surface condition of the recording member considerably affects the density of a formed image. What is worse, the recorded article obtained by using the pigment exhibits unsatisfactory abrasion resistance, for example, resistance against rubbing with the finger because the pigment is left on the surface of the recording member. In contrast to ink for writing materials, ink for use in ink jet recording operations must simultaneously satisfy many technical requirements, such as discharge stability, long-term dispersion stability (storage stability) and clogging prevention at the fine leading portion of the nozzle and the like. Therefore, all of the foregoing problems cannot be overcome by simply improving the composition of the ink.

SUMMARY OF THE INVENTION

Accordingly, an object of the present invention is to provide an ink jet recording method and ink jet recording apparatus capable of overcoming the foregoing problems and obtaining a recorded image exhibiting excellent image quality and fastness such as abrasion resistance, water resistance and light resistance while maintaining various characteristics, such as, discharge stability, storage stability and clogging prevention.

The foregoing object can be achieved by the present invention. According to one aspect of the present invention, there is provided an ink jet recording method for performing a recording operation by discharging an ink droplet composed of ink containing a pigment, a water soluble resin for dispersing the pigment and water to a member, on which data is recorded, the ink jet recording method comprising a step of: supplying a solution containing particles and/or binder polymer on to the recording member prior to discharging the ink.

According to another aspect of the present invention, there is provided an ink jet recording method for performing a recording operation by discharging an ink droplet composed of ink containing a pigment, polymer for dispersing the pigment and water to a recording member, the ink jet recording method comprising a step of: supplying a solution containing polymer, which has a polarity opposite the polarity of the polymer contained in the ink, on to the recording member prior to discharging the ink.

According to another aspect of the present invention, there is provided an ink jet recording method for performing a recording operation by discharging an ink droplet composed of ink containing a pigment, a water soluble resin for dispersing the pigment and water to a recording member, the ink jet recording method comprising a step of: supplying a solution containing acid on to the member prior to or after the ink is discharged.

According to another aspect of the present invention, there is provided an ink jet recording method for performing a recording operation by discharging an ink droplet composed of ink containing a pigment, a water soluble resin for dispersing the pigment and water to a recording member, the ink jet recording method comprising a step of: supplying a solution containing resin having an acid value of 30 to 100 and soluble in alkali on to the recording member prior to or after the ink is discharged.

According to another aspect of the present invention, there is provided an ink jet recording method for performing a recording operation by discharging an ink droplet composed of ink containing a pigment, a water soluble resin for dispersing the pigment and water to a recording member, the ink jet recording method comprising a step of: supplying a solution containing salt on to the member prior to or after the ink is discharged.

According to another aspect of the present invention, there is provided an ink jet recording method for performing a recording operation by discharging an ink droplet composed of ink containing a pigment, a water soluble resin for dispersing the pigment and water to a recording member, the ink jet recording method comprising a step of: supplying a solution containing a buffer solution on to the recording member prior to or after the ink is discharged.

According to another aspect of the present invention, there is provided an ink jet recording apparatus having means that supplies energy to ink to discharge the ink in the form of a droplet so that data is recorded on a recording member, the ink jet recording apparatus comprising: a main head for discharging an ink containing a pigment, a water-soluble resin for dispersing the pigment and water; and a sub-head for discharging a solution containing particles and/or binder polymer prior to performing a recording operation with the main head.

According to another aspect of the present invention, there is provided an ink jet recording apparatus having means that supplies energy to ink to discharge the ink in the form of a droplet so that data is recorded on a recording member, the ink jet recording apparatus comprising: a main head for discharging an ink composition containing a pigment, a polymer for dispersing the pigment and water; and a sub-head for discharging a solution containing polymer having a polarity that is opposite the polarity of the polymer contained in the ink composition.

According to another aspect of the present invention, there is provided an ink jet recording apparatus that supplies energy to ink to discharge the ink in the form of a droplet so that data is recorded on a recording member, the ink jet recording apparatus comprising: a main head for discharging an ink composition containing a pigment, a water soluble resin for dispersing the pigment and water; and a sub-head for discharging a solution containing acid prior to or after the recording operation is performed with the main head.

According to another aspect of the present invention, there is provided an ink jet recording apparatus that supplies energy to ink to discharge the ink in the form of a droplet so that data is recorded on a recording member, the ink jet recording apparatus comprising: a main head for discharging an ink composition containing a pigment, a water soluble resin for dispersing the pigment and water; and a sub-head for discharging a solution containing a resin having an acid value of 30 to 100 and which can be dissolved in alkali, prior to or after the recording operation is performed with the main head.

According to another aspect of the present invention, there is provided an ink jet recording apparatus for supplying energy to ink to discharge the ink in the form of a droplet so that data is recorded on a recording member, the ink jet recording apparatus comprising: a main head for discharging an ink composition containing a pigment, a water soluble resin for dispersing the pigment and water; and a sub-head for discharging a solution containing salt prior to or after the recording operation is performed with the main head.

According to another aspect of the present invention, there is provided an ink jet recording apparatus that supplies energy to ink to discharge the ink in the form of a droplet so that data is recorded on a recording member, the ink jet recording apparatus comprising: a main head for discharging ink containing a pigment, a water soluble resin for dispersing the pigment and water; and a sub-head for discharging a solution containing a buffer solution prior to or after the recording operation is performed with the main head.

DESCRIPTION OF THE PREFERRED EMBODIMENTS

Figure 1:
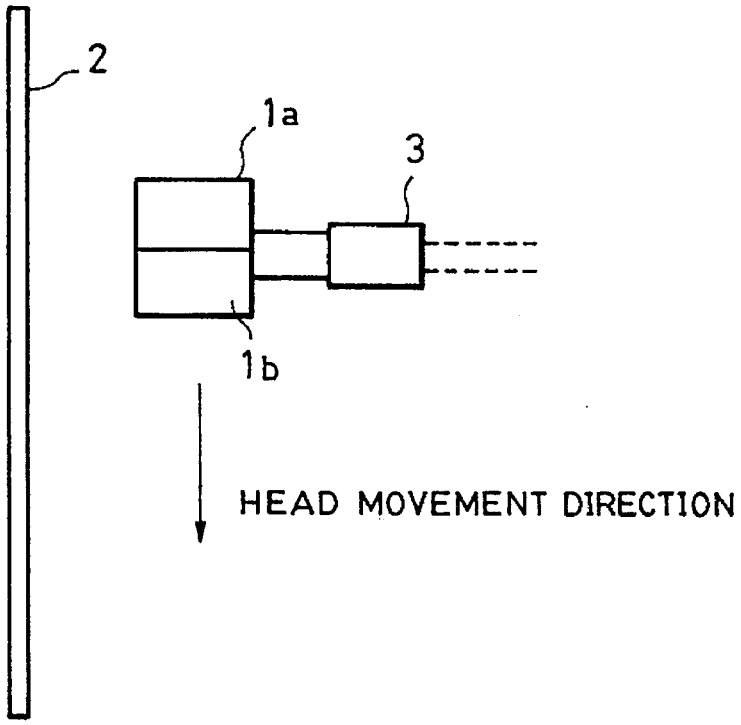
FIG. 1 is a schematic view which illustrates an example of an ink jet recording method according to the present invention.

The inventors of the present invention have made the following discoveries as a result of their extensive investigation of the relationship between the surface condition of a recording member and the density of a formed image.

That is, particles of pigment ink aggregate and remain on the surface of a recording member immediately after the pigment ink reaches the surface thereof. As a result, an image is formed. Therefore, if the surface condition of the recording member causes the ink dispersion state to be unstable, a satisfactory image density can be realized. If the pigment ink dispersion state is stable and penetration of the ink into the recording member occurs first, a satisfactory image density cannot be realized.

Typical plain papers widely used in offices are acid paper and neutral paper, each having various surface conditions to meet a number of recording purposes.

The design of an ink for obtaining a desired image density by making the ink dispersion condition unstable is balanced against accomplishing other requirements for an ink useful in the ink jet recording operation, such as discharge stability, storage stability and prevention of clogging at the fine leading portion of the nozzle.

A method of increasing the image density has been disclosed in, for example, Japanese Patent Laid-Open No. 63-145381 in which white resin particles are contained in a water-soluble ink composition for a writing tool, the ink composition containing a pigment and a dispersant. However, if the foregoing method is adapted to the ink jet recording method, long-term storage stability, discharge stability and the prevention of clogging at the fine leading portion of the nozzle cannot substantially be obtained. Therefore, a satisfactory recording effect cannot be obtained.

A number of methods have been reported for improving the abrasion resistance by causing a binder-like material to be contained in ink. However, the addition of the binder-like material raises the ink's viscosity, causing unsatisfactory storage stability, discharge stability and clogging.

Accordingly, the inventors of the present invention have searched for a way to satisfy the foregoing image density requirement. As one aspect of the present invention, it was found that jetting of particles or liquid containing particles and binder polymer prior to jetting of ink containing the pigment stabilizes the surface condition of a recording member at a constant state, and accordingly, an excellent recorded article can be provided regardless of the type of the recording member.

According to a second aspect of the present invention, liquid containing polymer having a polarity opposite the polarity of the polymer contained in ink is jetted onto a recording member prior to jetting of ink containing both pigment and polymer. As a result, the liquid first supplied to the recording member stabilizes the surface condition thereof. Further, mixture of the liquid first supplied and the ink causes the two polymers having opposing polarity react so that a polymer complex which is different from the two polymers is formed, the polymers being quickly aggregated. Therefore, the optical density can be raised, and particularly the abrasion resistance can be improved regardless of the type of recording member employed.

According to a third aspect of the present invention the dispersion stability of pigment ink deteriorates considerably if (1) acid is added in a small quantity, (2) a water-soluble resin having a small acid number is added, (3) salt is added in a small quantity and (4) a buffer solution is added in a small quantity and arranged so that liquid containing the foregoing materials is jetted or applied to the surface of the recording member prior to or after the pigment ink is jetted. In this case, the ink is immediately aggregated when it reaches the recording member. As a result, satisfactory quality of a formed image can be obtained regardless of the type of recording member.

The foregoing method makes use of a mechanism that the pH of the surface of the recording member is lowered due to, for example, the presence of acid thereon, so that the dispersion stability of the pigment ink that has reached the surface of the recording member is lost. Therefore, the pigment ink instantaneously aggregates on the surface of the recording member and the pigment component in the pigment ink composition is left so that the density of the recorded article is increased. Therefore, satisfactory fixing characteristics and recording density can be obtained.

In this third aspect of the invention, the particles dispersed in the pigment ink composition comprise the pigment particles, serving as the core, and a polymer compound usually containing a large quantity of carboxylic groups, where the polymer compound functions as a protection colloid which forms the shell around the pigment core. Therefore, the encapsulated pigment particle is stable in a water-soluble medium. However, the dissociation of the carboxylic group is restricted in an acidic environment of pH 4 to 5 or lower and, thus, the carboxylic group is not ionized.

As a result, repulsion between the particles is weakened, and the particles are isolated, causing the free movement of the particles to be restricted. Therefore, the coalescence and bonding of the particles are enhanced so that the dispersion is destroyed.

Since the aggregation of the particles is coalesce estimated to be about 50 to 150 millimicron in diameter, the commencement of the aggregation rapidly raises the viscosity, causing the medium to be eluted.

Also, the rise in the viscosity occurs considerably faster than the aggregation that occurs due to the presence of acid in a water-soluble dye. Therefore, the fixing characteristics can be improved significantly.

The water-soluble resin, having an acid value of 30 to 100, usually further contains hydrophobic monomer as monomer constituting the molecule. Therefore, the first supply of the water-soluble resin to the paper makes the surface of the paper acidic as well as improves the abrasion resistance of solidified ink after it has been aggregated since the water soluble resin serves as a medium.

A method similar to the present invention and arranged to jet a specific solution prior to jetting the ink has been previously suggested. For example, examples of the ink containing the water-soluble dye have been disclosed in Japanese Patent Laid-Open Nos. 56-89595 and 64-63185 in which a fluid is supplied prior to jetting of the ink to improve the sharpness and the water resistance of the printed article. However, the light resistance obtained and other image qualities have not been satisfactory.

In Japanese Patent Laid-Open No. 3-240557, a solution for raising the viscosity of the ink is jetted prior to or after the ink is jetted so that the rise in the viscosity of the ink is used to establish a recording method which is capable of preventing bleeding and which exhibits excellent fixing characteristics. However, the foregoing method takes a long time to fix the image because the viscosity of the ink is raised on the recording paper. What is worse, the rise of the viscosity is insufficient to completely leave the coloring material on the recording paper. Therefore, satisfactory printing density cannot always be obtained, resulting in an unsatisfactory image.

The present invention will now be described in greater detail.

According to the first aspect of the present invention, fluid to be supplied to the surface of a recording member prior to performing the ink jet recording contains at least particles or particles and binder polymer, water and a water-soluble organic solvent.

The particles contained in the fluid to be first-supplied are not limited particularly, and may be organic particles or inorganic particles if the employed material can be dissolved in water and can be stably dispersed. The form of the particle is not limited particularly. It is preferable to employ spherical particles. Specifically, the organic particles may be selected from a group consisting of polystyrene, styrene-acryl copolymer, polymethylmethacrylate, melamine resin, epoxy resin, silicon resin, benzoguanamine resin, polyamide resin, fluorine resin and polymer obtained by emulsion-polymerization of α, β-unsaturated ethylene monomer. The inorganic particles may be selected from a multiplicity of materials such as titanium dioxide particles or silica or alumina. The inorganic particles may be selected from the following products: Muticle series manufactured by Mitsui, ME series manufactured by Soken, Julimer ME series manufactured by Nihon Junyaku, Tospal series manufactured by Toshiba Silicon, Eposter series manufactured by Nihon Shokubai, Microdwell series manufactured by Nihon Paint, Fluon series manufactured by Asahi Glass. The inorganic particles may be particles selected from a group consisting of Titania series manufactured by Idemitsu and aluminum oxide manufactured by Nihon Aerozyl. A portion of the foregoing particles may be available in the form of a water-dispersing element.

Although the quantity of the particles contained in the foregoing fluid depends upon the specific gravity of the particles, it is preferable that the quantity with respect to the overall weight of the fluid ranges from 0.01 wt % to 20 wt %, more preferably from 0.01 wt % to 10 wt %. Although the particle size depends upon the diameter of the nozzle of the employed printer head, it is preferable that the particle size ranges from 0.01 μm to 5 μm, more preferably from 0.05 μm to 1 μm. The foregoing particles may be dispersed by using a surface active agent or the like in the event that the particles cannot be obtained as the dispersed element. Also the fact that the surface active agent is contained in the fluid to be jetted first is expected to increase the speed at which the fluid penetrates the paper. Therefore, the fixing characteristics of the ink to be jetted and the quality of the image are not adversely affected. The surface active agent is not limited particularly if it is able to disperse stably the foregoing particles in water. It may be any one of the following materials: an anionic surface active agent such as fatty acid salt, higher alcohol sulfate ester salt, fluid fatty oil sulfate ester salt, alkyl allyl sulfonic acid salt; and non-inonic surface active agents such as polyoxyethylene alkyl ether, polyoxyethylene alkylester, polyoxyethylene sorbitan alkylester, acetylene alcohol or acetylene glycol. The foregoing materials may be used solely or their combination may be used.

Although the binder polymer is not limited particularly, it is preferable to employ a material selected from the group consisting of polyvinyl alcohol, acrylic resin, polyacrylic acid soda, a cross-linking type acrylic polymer, polyacrylic amide, polyvinyl acetal, polyvinyl pyrrolidone, urethane resin, starch, gelatin, Pullulan, methylcellulose, hydroxymethylcellulose, hydroxypropylcellulose, carboxymethylcellulose, polyethylene oxide, polyvinyl methylether, an epoxy compound and polyester or their mixture. The content of the binder polymer in the fluid is about 0.001 to 20 wt % although it depends upon the type of the polymer.

As the organic solvent, a polyhydroxy alcohol or its alkyl ether or a water-soluble organic solvent such as a primary alcohol may be used.

Although the content depends upon the particular organic solvent, it is preferable that the solvent content ranges from 50 to 90 wt % with respect to the overall weight of the fluid.

The ink composition according to the first aspect of the present invention contains at least a pigment, water-soluble resin, water and a water-soluble organic solvent.

The quantity of the pigment contained in the ink according to the first aspect of the present invention ranges from 1 to 20 wt %, preferably 2 to 12 wt % with respect to the overall weight of the ink. The pigment used in the present invention is not limited if a selected pigment satisfies the foregoing performance characteristics. Carbon black for use in black ink may be carbon black manufactured by a furnace method or a channel method and having a primary particle size of 15 to 40 mμ, a specific surface area measured by a BET method of 50 to 300 $m^2/g$, a DBP oil absorption quantity of 40 to 150 ml/100 g, a volatile component of 0.5 to 10% and pH value of 2 to 9. The foregoing material may be the following commercially available product: No. 2300, No. 400, MCF88, No. 33, No. 40, No. 45, No. 52, MA7, MA8 and No. 2200B (manufactured by Mitsubishi); RAVEN1255 (manufactured by Columbia); REGAL400R, REGAL 330R, REGAL660R and MOGUL L (manufactured by Cabot); Color Black FW1, Color Black FW18, Color Black S170, Color Black S150, Printex 35, Printex U (Degussa) and the like. Further, another trial material adaptable to the present invention may be employed. Pigments useful as the yellow ink may be C.I. Pigment Yellow 1, C.I. Pigment Yellow 2, C.I. Pigment Yellow 3, C.I. Pigment Yellow 13, C.I. Pigment Yellow 16 or C.I. Pigment Yellow 83. Pigments useful as the magenta ink may be C.I. Pigment Red 5, C.I. Pigment Red 7, C.I. Pigment Red 12, C.I. Pigment Red 48 (Ca), C.I. Pigment Red 48 (Mn), C.I. Pigment Red 57 (Ca), C.I. Pigment Red 112 or C.I. Pigment Red 122. Pigments useful as the cyan ink may be C.I. Pigment Blue 1, C.I. Pigment Blue 2, C.I. Pigment Blue 3, C.I. Pigment Blue 15:3, C.I. Pigment Blue 16, C.I. Pigment Blue 22, C.I. Vat Blue 4 or C.I. Vat Blue 6 or the like. Further, another trial material adaptable to the present invention may be employed.

A dispersant for dispersing the pigment according to the first aspect of the present invention may be any one of water-soluble resins. It is preferable that the weight average molecular weight of the resin ranges from 1000 to 30000, more preferably 3000 to 15000. Specifically, the dispersant may be a block copolymer, graft copolymer or random copolymer composed of two or more monomers selected from the group consisting of styrene, styrene derivative, vinyl naphthalene, vinyl naphthalene derivative, aliphatic alcohol ester of α, β-ethylene unsaturated carboxylic acid, acrylic acid, acrylic acid derivative, maleic acid, maleic acid derivative, itaconic acid, itaconic acid derivative, fumaric acid or fumaric acid derivative. Further, the dispersant may be a salt of any one of the foregoing materials. The foregoing resins can be dissolved in a water solution, in which a base is dissolved, and can be dissolved in alkali. As an alternative to this, the dispersant may be a homopolymer composed of hydrophilic monomer or its salt. Further, the following water soluble resin may be employed: polyvinyl alcohol, carboxymethylcellulose, naphthalene sulfonic acid and formaldehyde condensate. If the resin which can be dissolved in alkali is used, advantages can be realized in that the viscosity of the dispersant can be lowered and that dispersion can easily be made. In order to raise the printing density, it is preferable to use a resin which commences its aggregation when the pH is 6 or lower. It is preferable that the foregoing water-soluble resin is contained in a range from 0.1 to 5 wt % with respect to the overall weight of the ink.

Further, it is preferable that the ink composition be adjusted to neutral or alkaline pH in order to improve the solubility of the water-soluble resin causing the ink to exhibit further improved long-term storage stability. It is preferable that the pH ranges from 7 to 10.

The pH adjuster may be an organic amine such as diethanolamine or triethanolamine, an inorganic alkaline material such as alkaline metal of sodium hydroxide, lithium hydroxide or potassium hydroxide, inorganic acid or mineral acid.

The pigment and the water-soluble resin are dispersed or dissolved in a water-soluble medium.

A preferred water-soluble medium for use in the ink according to the first aspect of the present invention is a mixture solvent of water and a water-soluble organic solvent. It is preferable that the water used be ion-exchanged water (deionized water).

The water-soluble organic solvent to be used while being mixed with water may be: alkyl alcohol having one to four carbons such as methyl alcohol, ethyl alcohol, n-propyl alcohol, isopropyl alcohol, n-butyl alcohol, sec-butyl alcohol or tert-butyl alcohol; amide such as dimethyl amide or dimethyl acetoamide; ketone or ketoalcohol such as acetone or diacetone; polyalkylene glycol such as polypropylene glycol; alkylene glycol containing an alkylene group having 2 to 6 carbons such as ethylene glycol, propylene glycol, butylene glycol, triethylene glycol, 1,2,6-hexanetriol, thiodiglycol, hexylene glycol, diethylene, glycol; glycerine; lower alcohol alkyl ether of polyhydroxy alcohol of diethylene glycol methyl (or ethyl) ether or triethylene glycol monomethyl (or ethyl) ether; N-methyl-2-pyrrolidone, 2-pyrrolidone or 1,3-dimethyl-2-imdidazolidinone. It is preferable to employ lower alkyl ether of a polyhydroxy alcohol such as diethylene glycol or triethylene glycol monomethyl (ethyl) ether.

In order to realize the desired discharge stability, it is effective to add ethanol or isopropyl alcohol by 1% or more. By adding the foregoing solvent, bubble formation of ink on a thin film resistor can be further stabilized. Further, the addition of the foregoing solvent to the dispersant prevents bubble generation at the time of the dispersion so that the dispersion can be performed efficiently. It is preferable that the solvent be added by 3 to 10 wt % with respect to the overall weight of the ink composition.

The content of the water-soluble organic solvent in the ink according to the first aspect of the present invention usually ranges from 3 to 50 wt % with respect to the overall weight of the ink composition. It is preferable that water-soluble organic solvent ranges from 3 to 40 wt %, and water ranges from 10 to 90 wt % of the overall weight of the ink composition, and preferably from 30 to 80 wt %.

The ink composition according to the first aspect of the present invention may further contain a surface active agent, an antifoaming agent and an antiseptic agent if necessary to cause the ink to have the desired physical properties. Further, a commercially available water-soluble dye may be added.

The surface active agent is not limited particularly if it is any one of the foregoing materials that does not adversely affect the storage stability and the like. One or more materials may be used. Although the quantity of the surface active agent depends upon the type of the dispersant, it is preferable that the quantity be 0.01 to 5 wt % with respect to the overall weight of the ink composition. It is preferable that the quantity of the active agent be so made that the surface tension of the ink is made to be 30 dyne/cm or more. If the surface tension of the ink is smaller than the foregoing value, the formed data can be deflected (the direction in which the ink is jetted toward the recording member surface is deviated) due to the fact that the leading portion of the nozzle is wet.

The ink composition according to the first aspect of the present invention is manufactured by steps of: first adding a pigment to a solution containing at least the water-soluble resin and water; stirring the solution; dispersing the solution by using a dispersing means (to be described later); and centrifugally-separating the solution if necessary so that a fluid having the desired degree of dispersion is obtained. Then, for example, the water-soluble medium, a pH adjuster and optional stabilizers are added to the foregoing dispersed fluid and stirred so that the ink composition is obtained.

In the case where the alkali-soluble resin is used, base must be added in order to dissolve the resin. The base to be added to the dispersed fluid is preferably any one of the following materials: organic amine such as monoethanol amine, diethanol amine, triethanol amine, amine methyl propanol or ammonia; and inorganic base such as potassium hydroxide or sodium hydroxide.

It is preferable that premixing be performed for 30 minutes or longer prior to performing the dispersion of the solution containing the pigment. The premixing operation improves the wettability of the surface of the pigment to enhance the adsorption to the surface of the pigment.

A dispersing machine for use in the present invention may be an ordinary machine, for example, a ball mill, a roll mill and a sand mill.

Among those, a satisfactory effect will be obtained by using a high-speed-type sand mill exemplified by Super Mill, Sand Grinder, Beads Mill, Agitator Mill, Grain Mill, Dyno Mill, Pearl Mill and Cobol Mill (all are trade names).

In order to obtain the pigment having a desired particle size distribution, any one of the following methods may be employed: a method of decreasing the size of the crushing medium of the dispersing machine; a method of raising the charge ratio of the crushing medium; a method of lengthening the time in which the process is performed; a method of lowering the discharge speed; and a method of performing classification by using a filter or a centrifugal separator or the like after the crushing has been performed.

Figure 2:
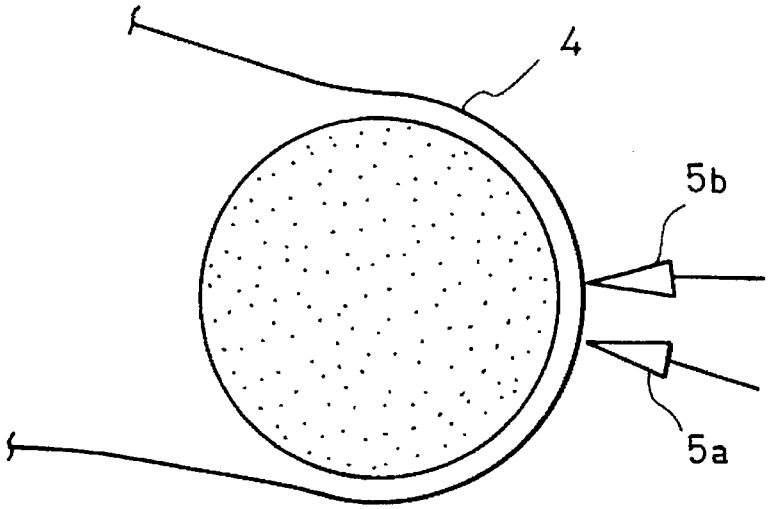
FIG. 2 is a schematic view which illustrates another example of an ink jet recording method according to the present invention.

The fluid containing the foregoing particles and/or the binder polymer is supplied to the recording member surface. Specifically, the fluid is applied by spraying or by using a bar-coater prior to performing recording. As shown in FIGS. 1 and 2, an apparatus comprising an ink jet head containing the foregoing fluid may be comprised individually from the ink jet head containing the ink. In this case, the ink jet recording method according to the present invention is arranged as schematically shown in FIG. 1. Referring to FIG. 1, the fluid containing the foregoing particles and/or binder polymer is jetted from a sub-head 1*b*. Then, the ink is jetted from a main head la after a predetermined time delay so that recording is performed. In order to substantially align the ink droplet jetted from the main head 1*a* with the position at which a droplet previously jetted from the sub-head 1*b* on the recording member, the two heads are array vertically, as shown in FIG. 1. Printing may be performed by disposing the main head 5*a* and the sub-head 5*b* as shown in FIG. 2. Referring to FIG. 2, reference numeral 2 represents the recording member. A structure may be employed in which two fluid chambers are formed in one head to simultaneously jet two types of fluids.

A second aspect of the present invention will now be described.

In the second aspect of the present invention, fluid to be supplied to the recording member surface prior to performing jetting of ink contains at least polymer, water and water-soluble organic solvent, the foregoing polymer having the polarity opposite the polarity of the polymer contained in the ink.

The polymer contained in the fluid is not limited particularly if it can be dissolved in water or water-soluble organic solvent. The basic polymer (that is, if the polymer contained in the ink is acid polymer) is exemplified by: homo polymer such as N-vinyl pyrrolidone, N-vinyl-5-methyl pyrrolidone, N-vinyl-3-methyl pyrrolidone, N-vinyl-3,3-5-trimethyl pyrrolidone, N-vinyl-3-benzyl pyrrolidone, N-vinyl piperidone, N-vinyl-4-methyl piperidone, N-vinyl caprolactam, N-vinyl capryl lactam, N-vinyl-3-morpholine, N-vinyl thiopyrrolidone or N-vinyl-2-pyridone, or random, block or graft copolymer with another usual monomer (defined below); homo polymer such as N-vinyl-2-oxazolidone, N-vinyl-5-methyl-2-oxazolidone, N-vinyl-5-ethyl-2-oxazolidone, N-vinyl-4-methyl-2-oxazolidone, N-vinyl-2-thiooxazolidone, N-vinyl-2-mercaptobenzothiazole or random, block or graft copolymer with another usual monomer; homo polymer such as N-vinyl imidazole, N-vinyl-2-methyl imidazole, N-vinyl-4-methyl imidazole, or random, block or graft copolymer with another usual monomer; a homo polymer such as 2 or 4-vinyl pyridine or random, block or graft copolymer with another usual monomer. The term "usual monomer" is exemplified by methacrylate, acrylate, acrylic amide, acrylonitrile, vinyl ether, vinyl acetate, vinyl imidazole, ethylene, styrene or the like. It is preferable to employ the following mono polymer or copolymer such as mono polymer or copolymer of N-vinyl pyrrolidone, N-vinyl piperidone, N-vinyl caprolactam, N-vinyl capryl lactam, N-vinyl-morpholine, N-vinyl-2-oxazolidone, N-vinyl-5-methyl-2-oxazolidone or acryl amide.

As the acid polymer (that is, if the polymer contained in the ink composition is alkaline), any one of the following material may be used: an acidic cellulose derivative denatured by any one of a variety of polycarbonic acid, a mono polymer of vinyl ester monomer of polycarboxylic acid, or random, block or graft copolymer with another usual monomer; a mono polymer of monomer such as acrylic acid or methacrylic acid or random, block or graft copolymer with another usual monomer; a mono polymer such as α, β-unsaturated vinyl monomer of maleic acid anhydride or itaconic acid, or random, block or graft copolymer with another usual monomer; cellulose derivative such as ortho-ethyl cellulose hydrogen acetate hydrogen sulfate phthalic acid ester, cellulose hydrogen acetate hydrogen sulfate phthalic acid, ethyl cellulose hydrogen-ortho-sulfobenzoic acid ester, ortho-para-sulfonbenzyl cellulose acetate ester, ortho-ethyl-ortho-para-sulfoethyl cellulose acetate ester; sulfonic acid denatured polymer by polyvinyl alcohol or vinyl alcohol copolymer, ethyl cellulose, hydroxyethyl/ethyl cellulose, hydroxyethyl/benzyl cellulose; a mono polymer of monomer having sulfonic acid or phenol group or random, block or graft copolymer with usual monomer; and an acid denatured substance of any one of various polymers by a compound containing carboxylic groups or sulfonic acid groups or phenol groups. Although any one of the foregoing materials can be used, it is preferred to use α, β-unsaturated homo polymer, random, block or graft copolymer.

Although the content of the polymer used in the fluid depends upon the particular type of the polymer, it is preferable that the content is 0.001 to 20 wt % with respect to the overall weight of the fluid.

As the organic solvent, a water-soluble organic solvent, such as a polyhydroxy alcohol or its alkyl ether or a primary alcohol is used. Although its content depends upon the type of the organic solvent, it is preferable that the content be 50 to 90 wt % with respect to the overall weight of the fluid.

The ink according to the second aspect of the present invention contains at least the pigment, a water-soluble resin (the foregoing polymer having a polarity opposite the polarity of the polymer contained in the fluid), water and the water-soluble organic solvent.

The dispersant for the pigment for use in the second aspect of the present invention may be any one of water-soluble resins. It is preferable that the weight average molecular weight of the resin ranges from 1000 to 30000, more preferably ranges from 3000 to 15000. Specifically, the dispersant may be a block, random or graft copolymer composed of one or more types of monomer selected from the group consisting of styrene, styrene derivative, vinyl maphthalene, vinyl napthaline derivative, aliphatic alcohol ester such as α, β-ethylene unsaturated carboxylic acid, acrylic acid, acrylic acid derivative, maleic acid, maleic acid derivative, itaconic acid, itaconic acid derivative, fumaric acid, and fumaric acid derivative. The dispersant may be a salt of the foregoing materials. The foregoing resins are soluble in a water solution in which a base is dissolved and are resins which can be dissolved in alkali. That is, they are acid polymers. The dispersant may be homopolymer composed of hydrophilic monomer or its salt. A water-soluble resin, such as polyvinyl alcohol, carboxymethyl cellulose or naphthalene sulfonate formaldehyde condensation substance may be used.

As the basic polymer for the pigment dispersion in this second aspect of the invention, the polymers used in the fluid, which is supplied prior to performing the ink jet recording operation according to the second aspect of this invention, can be used if it is able to disperse the pigment stably. It is preferable that random, block or graft copolymer with homopolymer of acrylic amide or other usual monomer be employed.

Advantages of lowering the viscosity of the dispersant and facilitating the dispersion can be realized for the ink according to the second aspect of the present invention to use the resin, which can be dissolved in alkali, that is, the acid polymer as the dispersant. It is preferable to use a resin which commences its aggregation when the pH is lower than 6 because the image density can be improved. It is preferable that the foregoing water-soluble resin be contained in a range from 0.1 to 5 wt % with respect to the overall weight of the ink.

Since the pH of the ink sometimes causes members in the ink jet recording apparatus to be corroded, it is preferable that the pH of the ink be maintained in the range of 7 to 10.

The pigment, the water, the water-soluble organic solvent and the optional additives added if necessary and their contents are similar to those of the ink composition according to the first aspect of the present invention. Further, the method of preparing the ink composition is the same as ink preparation according to the first aspect of the present invention.

The method of supplying to the recording member the fluid having inverse polarity relative to the polarity of the polymer contained in the ink is the same as the method according to the first aspect of the present invention.

A third aspect of the present invention will now be described. The fluid according to this aspect of the invention and to be supplied to the recording member surface prior to performing the ink jet recording operation contains at least water, a water-soluble organic solvent and a compound that is acidic in the fluid. Such a compound is exemplified by acid, a water soluble resin having a low acid value, salt and buffer fluid.

The acid is not limited particularly if it is an acid in a water solution. The acid of this type is exemplified by hydrochloric acid, acetic acid, a compound having a carboxylic group, carbonic acid, sulfonic acid, a compound having a sulfonic acid group, nitric acid, phosphoric acid, and phosphoric compound, sulfurous acid, nitrous acid and the like.

The water-soluble resin having a small acid value is not limited particularly if the material is a resin which can be dissolved in alkali, which has an acid value from 30 to 100 and which can stably be dissolved in water in which a base is also dissolved. It is preferable that the weight average molecular weight of the resin is 1000 to 30000, more preferably 3000 to 15000. If a resin having a large molecular weight is used, smooth deposition cannot be expected and a resultant rise in the viscosity of the fluid occurs, deteriorating the fixing speed. Therefore, it is preferable to use a resin having a small molecular weight. Specifically, a block, graft or random copolymer composed of one or more monomers selected from the group consisting of styrene, styrene derivative, vinyl naphthalene, vinyl naphthalene derivative, aliphatic alcohol ester of α, β-ethylene unsaturated carboxylic acid, acrylic acid, acrylic acid derivative, maleic acid, maleic acid derivative, itaconic acid, itaconic acid derivative, fumaric acid or fumaric acid derivative. As an alternative to this, a salt of any one of the foregoing materials may be used. The present invention is not limited to the foregoing materials if the material can be dissolved in water in which base is also dissolved.

The salt is not limited particularly if the salt can be stably dissolved in water. Useful in this aspect of the inventions are salts exemplified by: chloride salts such as sodium chloride, potassium chloride, lithium chloride, ammonium chloride, calcium chloride, magnesium chloride or barium chloride; carbonic salts such as calcium carbonate, magnesium carbonate, barium carbonate, sodium carbonate, lithium carbonate or ammonium carbonate; acetate salts such as sodium acetate, potassium acetate or lithium acetate; sulfate salts such as sodium sulfate, potassium sulfate or aluminum sulfate; nitrate; sulfite; or nitrite. However, the salt is not limited particularly so long as it can be dissolved in water and dissociated electrolytically.

A buffer solution is not limited particularly if the selected buffer solution has the pH of 3 to 9 in terms of improving the contact with the members of the print head and an effect of aggregating the ink. It is preferable that a buffer solution having a pH of 3 to 6 be employed. Specifically, the buffer solution is exemplified by Clark-Lubs's buffer solution, Sφrensen's buffer solution, Kolthoff's buffer solution, Michaelis's buffer solution, McIlvaine's buffer solution, Britton-Robinson's buffer solution, Carmody's buffer solution, Gomori's buffer solution and Bates-Bower's buffer solution.

If the ink composition according to the third aspect of the present invention contains the resin which serves as a dispersant, which can be dissolved in alkali and which commences aggregating when the pH is 6 or lower, it is preferable that a buffer solution having pH of 6 or lower be used.

The quantity of the acid in the foregoing fluid ranges from 0.01% to 20% by weight, more preferably ranges from 0.05% to 10%. The quantity of the water-soluble resin, which can be dissolved in alkali and having the acid value of 30 to 100 ranges from 0.1% to 20%, more preferably ranges from 1 to 10%. The amine or the base for dissolving the resin must be added in a quantity which is one or more times the quantity of the amine or the base calculated from the acid value of the resin. The quantity of the amine or the base can be obtained by the following equation:

Quantity of amine or base (g)=(the acid number of resin×molecular weight of amine or base×quantity (g) of resin)/5600

The fluid containing the water-soluble resin is prepared by mixing the resin in a water solution in which the base is dissolved in the quantity calculated by the foregoing equation. The mixture is then heated to about 60° C., with stirring it for about one hour to prepare the resin solution, and, if necessary, a water-soluble solvent and other additives are added to the foregoing solution.

The quantity of the base ranges from 0.1% to 20% by weight, preferably ranges from 1% to 10%. If the buffer solution is used, its quantity can be determined depending upon a desired pH and the type of the selected buffer solution.

In the third aspect of the present invention, the foregoing fluid must be designed so that it is able to quickly penetrate the paper to prevent influence upon the ink fixing speed and the quality of the formed image. In order to achieve the foregoing object, it is preferable that any one of the following surface active agents that exhibit excellent penetration characteristics into the paper be included in the fluid: negative ion surface active agents such as fatty acid salt, higher alcohol sulfate salt, fluid fatty oil sulfate salt or alkyl allyl sulfonic acid salt; non-ionic surface active agent such as polyoxyethylene alkyl ether, polyoxyethylene alkyl ester, polyoxyethylene sorbitan alkyl ester, acetylene alcohol or acetylene glycol. As the organic solvent, a water-soluble organic solvent such as a polyhydroxy alcohol, its alkyl ether, or a primary alcohol is used.

Although the content depends upon the particular organic solvent employed, it is preferable that the solvent content be present about 50 to 90 wt % with respect to the overall weight of the fluid.

The ink composition according to the third aspect of the present invention contains at least the pigment, the water-soluble resin which disperses the pigment, and the water-soluble organic solvent.

The materials essential to the ink composition, the optional additives and their respective contents are the same as those of the ink according to the first aspect of the present invention. Further, the methods of preparing them are the same.

In the third aspect of the present invention, the acid fluid may be supplied after the ink has been supplied to the recording member, as well as in the manner supplied in the method according to the first aspect of the present invention (i.e., prior to jetting of ink).

A recording apparatus according to the present invention will now be described.

A recording apparatus for practicing the three aspects of the present invention may be an apparatus for jetting a droplet by vibrating a piezoelectric oscillator thereof in response to a supplied recording signal. Alternatively, an apparatus in which heat energy, generated in response to a recording signal, is supplied to the ink in the chamber of the recording head to cause a droplet of ink to form.

Figure 3A:
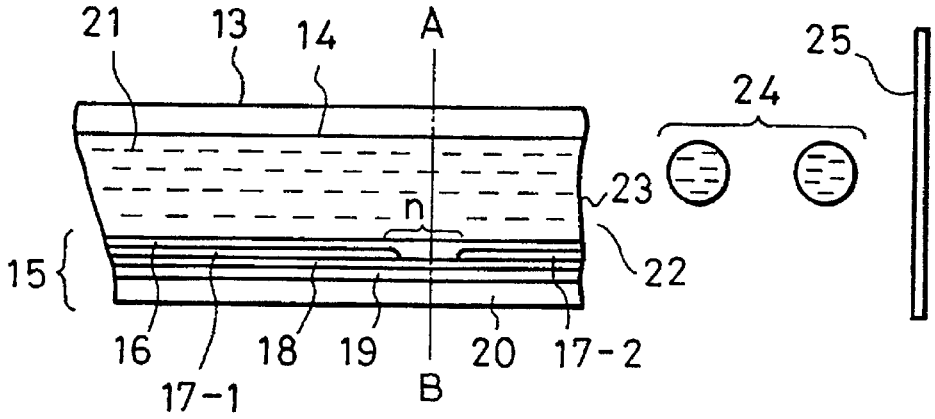
FIG. 3A is a cross sectional view which illustrates an example of the structure of a head for jetting ink by using heat energy.
Figure 3B:
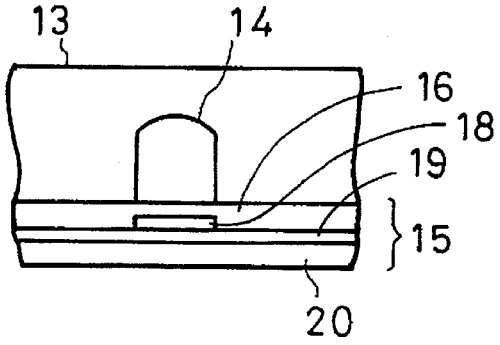
FIG. 3B is a cross sectional view taken along line A-B of FIG. 3A.

FIGS. 3A and 3B illustrate an example of a head for jetting the ink by using heat energy, the head being an essential portion of the recording apparatus. FIG. 3A is a cross sectional view which illustrates the head 13 disposed to face the ink passage. FIG. 3B is a cross sectional view taken along line A-B shown in FIG. 3A. Although a thin film head is illustrated in FIGS. 3A and 3B, the present invention is not intended to be so limited. A head 13 is manufactured by bonding a glass, ceramic or plastic plate having a groove 14 through which the ink passes and a heat-generating head 15 for use in the heat sensitive recording. The heat-generating head 15 comprises a protective film 16 made of silicon oxide, aluminum electrodes 17-1, 17-2, a heat resistor layer 18 made of nichrome, a heat-generating layer 19 and a substrate 20 made of alumina or the like which radiates heat satisfactorily.

Ink 21 reaches a discharge orifice (small aperture) 22 to form a meniscus 23 due to pressure P.

Figure 4:
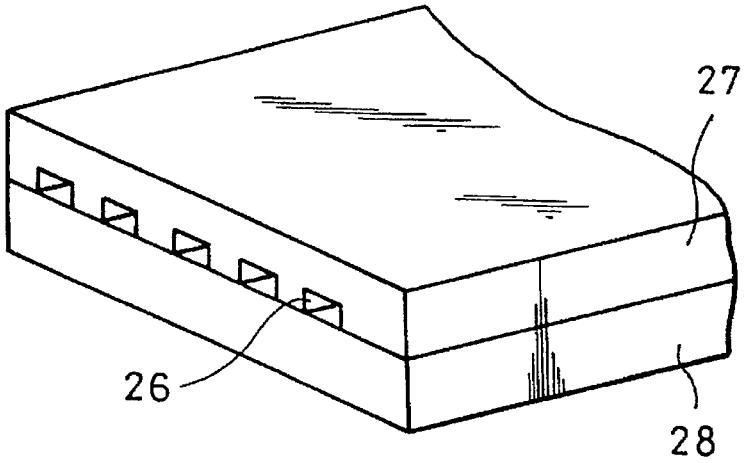
FIG. 4 is a cross sectional view which illustrates a multi-head structure constituted by arranging a multiplicity of heads shown in FIG. 3A.

When electric signals are supplied to the electrodes 17-1 and 17-2, a region expressed by n of the heat-generating head 15 rapidly generates heat. As a result, the ink 21 in contact with the region n generates bubbles, the pressure of which produces the meniscus 23. Therefore, the ink 21 is discharged while being formed into a recording droplet 24 by the orifice 22 to fly toward a recording member 25. FIG. 4 illustrates a multi-head having a multiplicity of heads of the type shown in FIG. 3A and arranged therein. The multi-head is formed by bonding a glass plate 27 having a multi-groove 26 and a heat-generating head 28 arranged similarly to that shown in FIG. 3A.

Figure 5:
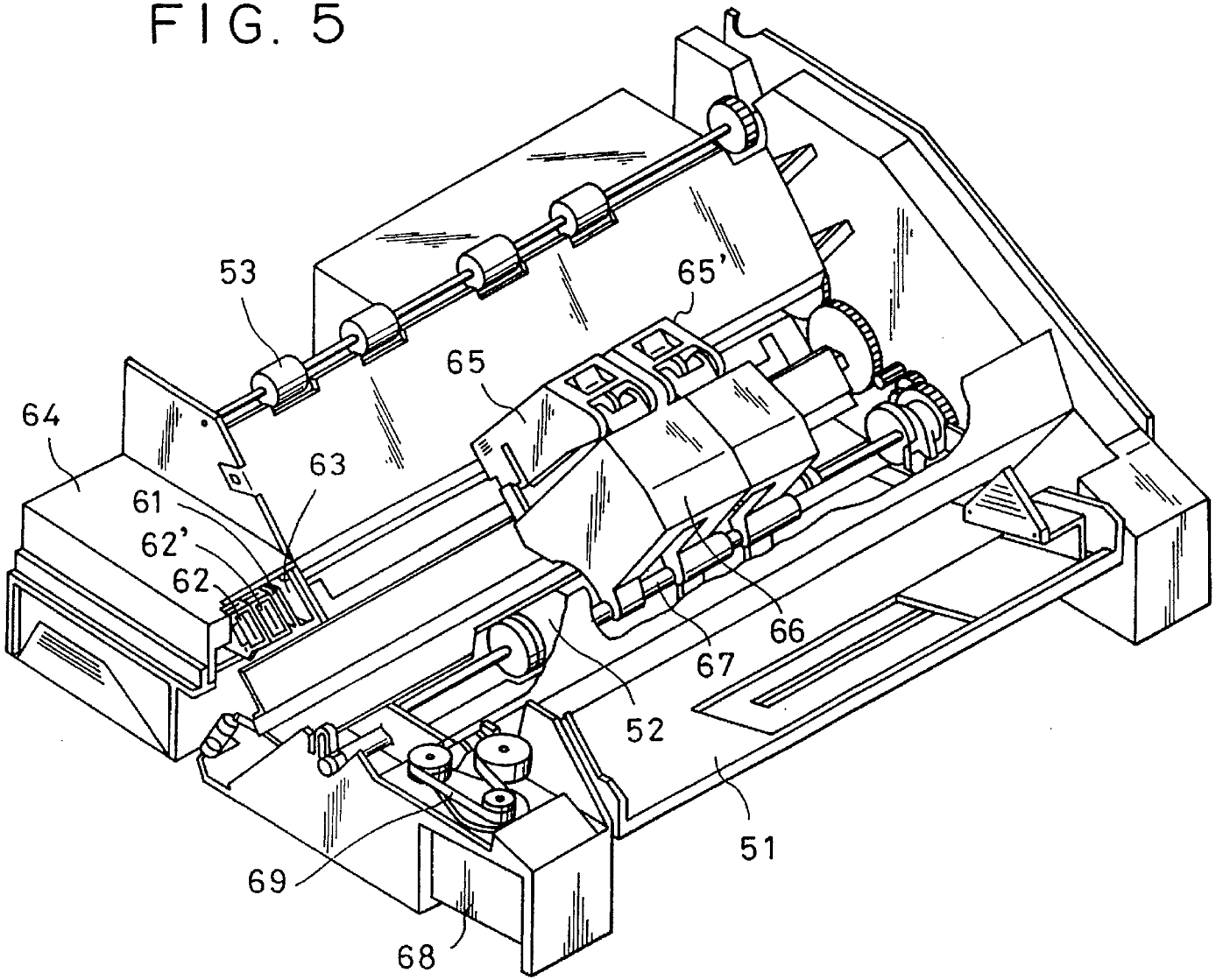
FIG. 5 is a perspective view which illustrates an example of an apparatus to which the ink jet recording method according to the present invention is adapted.

FIG. 5 illustrates an example of the apparatus adapted for practicing the ink jet recording method according to the first, second and third aspects of the present invention. Referring to FIG. 5, reference numeral 61 represents a blade serving as a wiping member, the blade 61 having an end so held by a blade holding member so as to be fixed at that end. As a result, a cantilever shape is formed. The blade 61 is disposed adjacent to a region in which the recording head performs the recording operation. In this embodiment, the blade 61 is held while being projected into the passage through which the recording head is moved. Reference numerals 62 and 62' represent caps disposed at the home position adjacent to the blade 61. Caps 62 and 62' are so structured as to perform capping of the recording head by moving in a direction that is perpendicular to a direction in which the recording head is moved, so as to make contact with the discharge surface of the head. Reference numeral 63 represents an ink absorber disposed adjacent to the blade 61, and being held similarly to the blade 61 (i.e., fixed at one end) so that the ink absorber 63 projects into the passage through which the recording head is moved. The blade 61, the caps 62 and 62' and the ink absorber form a discharge restoring portion 64 so that water and dust on the ink discharge surface are removed by the blade 61 and the absorber 63. Reference numerals 65 and 65' represent recording heads having a discharge energy generating means, for discharging ink to a recording member, that is disposed to face the discharge surfaces of the heads, and a discharge port. The head 65 accommodates the pigment ink, while the head 65' accommodates the fluid according to the present invention. The fluid contained in each of the recording heads 65 and 65' can be replaced easily. Reference numeral 66 represents a carriage having the recording heads 65 and 65' mounted thereon for moving the recording heads 65 and 65'. The carriage 66 is slidably engaged with a guide shaft 67. The carriage 66 also has a portion (omitted from illustration) connected to a belt 69 which is driven by a motor 68. As a result, the carriage 66 can be moved along the guide shaft 67 so that the recording heads 65 and 65' can be moved to the recording region and adjacent regions.

Reference numeral 51 represents a paper feeding portion through which the recording member (not shown) is inserted. Reference numeral 52 represents a paper feeding roller to be rotated by a motor (omitted from illustration). As a result of the structure described above, the recording member is moved to a position at which it faces the discharge port surface of the recording head. As the recording operation proceeds, the recording member is discharged to a paper discharge portion, in which paper-discharge roller 53 is disposed.

When the recording heads 65 and 65' are returned to the home position after the recording operation has been completed, the caps 62 and 62' of the head restoring portion 64 are moved outside the path through which the recording heads 65 and 65' are moved. The blade 61 projects into the path of movement. As a result, the discharge port surfaces of the recording heads 65 and 65' are wiped off. When the caps 62 and 62' come in contact with the discharge port surfaces of the recording heads 65 and 65' to cap them, the caps 62 have been moved to project into the path through which the recording heads 65 and 65' are moved.

When the recording heads 65 and 65' are moved to the recording commencement position from the home position, the caps 62 and 62' and the blade 61 are positioned at the position at which the wiping operation is performed. As a result, the discharge port surfaces of the recording heads 65 and 65' are also wiped off just prior to moving into a recording position.

In addition to the movement of the recording heads 65 and 65' to the home position at the time of the completion of the recording operation and the discharge restoring operation, the recording heads 65 and 65' are periodically moved to the home position adjacent to the recording region during their movements to the recording regions so that the foregoing wiping operation is performed. It should be noted that the ink absorber 63 acts in concert with the wiping blade 61 during the repeating wiping operation.

Figure 6:
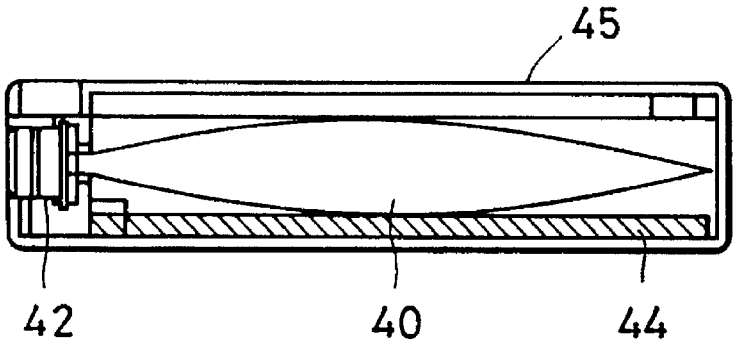
FIG. 6 is a cross sectional view which illustrates an example of an ink cartridge.

FIG. 6 illustrates an example of an ink cartridge 45 which accommodates the ink to be supplied to the heads 65 and 65' through ink supply tubes. Reference numeral 40 represents an ink bag which accommodates ink to be supplied, the ink bag 40 having a rubber cap 42 at the leading portion thereof. By inserting a needle (omitted from illustration) into the cap 42, the ink in the ink bag 40 can be supplied to the recording heads 65 and 65'. Reference numeral 44 represents an ink absorber for receiving waste ink.

The ink jet recording apparatus according to the present invention is not limited to the foregoing type comprising heads and an ink cartridge that are disposed individually. An ink jet recording apparatus comprising the foregoing elements formed integrally may also be used.

Figure 7:
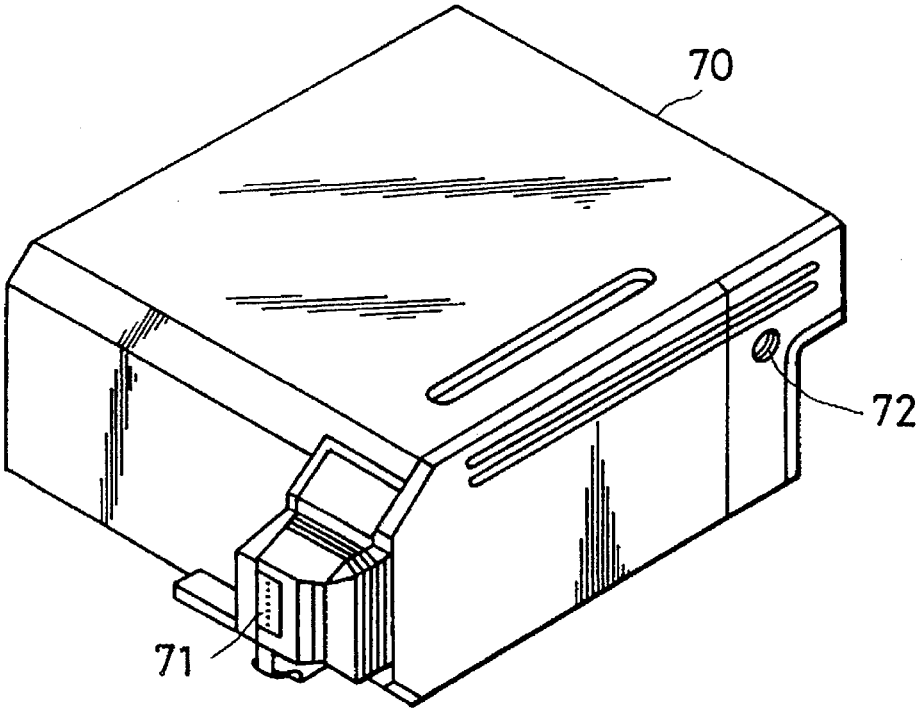
FIG. 7 is a perspective view which illustrates a recording apparatus constituted by integrating a head and a cartridge.

Referring to FIG. 7, reference numeral 70 represents an ink jet cartridge which accommodates the ink absorber impregnated with the ink. The ink in the ink absorber is discharged while being formed into a droplet from a head portion 71 having a plurality of orifices. Reference numeral represents an atmosphere communication port by which the inside of the cartridge is connected to the external atmosphere.

The ink jet cartridge 70 is used in place of the recording heads 65 and 65' shown in FIG. 5, and is made to be detachable with respect to the carriage 66.

EXAMPLES 1, 2, 3 AND 4

(1) Preparation of Fluids (a) to (d):

The following composition (a) was prepared as the fluid to be first supplied to the recording member:

| | |
|---|---|
| Nippemicrojell E-3101 (styrene-acryl copolymer manufactured by Nihon Paint which has a particle size of about 0.3 μm and which is a 19.7%-water dispersant) | 5 parts |
| Glycerine | 10 parts |
| Ethyl alcohol | 3.5 parts |
| Polyvinyl alcohol PVA117 (manufactured by Kurare) | 0.5 part |
| Ion exchanged water | 81 parts |

The foregoing materials were weighed precisely and mixed in 60° C.-water bath. The mixture was stirred and dispersed with ultrasonic waves for one hour to form fluid (a).

Similarly, fluid (b) was prepared by the same method as that for preparing fluid (a), having the following composition:

| | |
|---|---|
| ME1000CF (polymethylmethacrylate manufactured by Soken, having a particle size of about 0.4 μm and 40%-water dispersant) | 20 parts |
| Ethylene glycol | 30 parts |
| Hydroxypropyl cellulose HPC-M (manufactured by Nihon Soda) | 0.2 part |
| Ion exchanged water | 48.8 parts |

Fluid (c), prepared by the same method as that for preparing fluid (a), had the following composition:

| | |
|---|---|
| Titania IT-S (surface hydrophilic titanium dioxide manufactured by Idemitsu and having a particle size of about 0.2 μm and 100% powder) | 1 part |
| Thiodiglycol | 30 parts |
| Acetylenol EH (manufactured by Kawaken) | 0.5 part |

-continued

| | |
|---|---|
| Polyvinyl pyrrolidone PVPK-60 (manufactured by G.A.F.) | 0.2 part |
| Ion exchanged water | 68.3 parts |

Fluid (d), prepared by the same method as that for preparing fluid (a), had the following composition:

| | |
|---|---|
| Tospearl 103 (silicon resin manufactured by Toshiba Silicon and having a particle size of about 0.3 μm and 100% powder) | 1.5 parts |
| Glycerine | 10 parts |
| Ethyl alcohol | 10 parts |
| Emalgen 913 (manufactured by Kao) | 0.5 part |
| Polyethylene oxide Alcox R-400 (manufactured by Meisei) | 1 part |
| Ion exchanged water | 77 parts |

(2) Preparation of Inks (A) to (C)

| INK A | |
|---|---|
| Styrene-acrylic acid-butyl acrylate copolymer (acid value: 116, weight average molecular weight: 3700) | 1.5 parts |
| Monoethanol amine | 1 part |
| Ion exchanged water | 81.5 parts |
| Diethylene glycol | 5 parts |

The foregoing components were mixed and heated to 70° C. in water bath to dissolve the resin component completely. Then, 10 parts of carbon black (MCF88 manufactured by Mitsubishi Kasei) and 1 part of isopropyl alcohol were added to the resin solution, and then pre-mixed for 30 minutes. Next, a dispersant process was performed under the following conditions:

| | |
|---|---|
| Dispersing machine: | sand grinder (manufactured by Igarashi) |
| Crushing medium: | zirconium beads having a diameter of 1 mm |
| Charge ratio of crushing medium: | 50% (volume) |
| Time in which crushing is performed: | 3 hours |

Further, centrifugal separation (12000 RPM for 20 minutes) was performed to remove coarse and large particles, completing the preparation of the dispersant solution. The dispersant solution containing the pigment was then combined with the following components in the quantities specified:

| | |
|---|---|
| Dispersant solution | 10 parts |
| Glycerine | 2 parts |
| Diethylene glycol | 15 parts |
| N-methyl pyrrolidone | 5 parts |
| Isopropyl alcohol | 3 parts |
| Ion exchanged water | 65 parts |

The components were mixed together and the pH of the mixture was adjusted to be 8 to 10 with monoethanol amine, to form ink (A).

| INK B | |
|---|---|
| Styrene-maleic acid-maleic acid half ester copolymer (acid value: 200 and weight average molecular weight: 12000) | 4 parts |
| Aminomethyl propanol | 2 parts |
| Ion exchanged water | 74 parts |
| Diethylene glycol | 5 parts |

The foregoing components were mixed, and then heated at 70° C. in water bath so that the resin component was dissolved completely. Then, 15 parts of carbon black (MCF88 manufactured by Mitsubishi Kasei) were added to the resin solution, and then pre-mixed for 30 minutes. Then, a dispersing process was performed under the following conditions:

| | |
|---|---|
| Dispersing machine: | Pearl Mill (manufactured by Ashizawa) |
| Crushing medium: | glass beads having a diameter of 1 mm |
| Charge ratio of crushing medium: | 50% (volume) |
| Discharging speed: | 100 ml/min. |

Further, centrifugal separation (12000 RPM for 20 minutes) was performed to remove coarse and large particles, to complete the preparation of the dispersant solution. The dispersant solution containing the pigment was then combined with the following components in the quantities specified:

| | |
|---|---|
| Dispersant solution | 20 parts |
| Glycerine | 8 parts |
| Ethylene glycol | 5 parts |
| Ethanol | 5 parts |
| Ion exchanged water | 61.5 parts |

The components were mixed together, and then the pH of the mixture was adjusted to be 8 to 10 with aminomethyl propanol to form ink (B).

| | |
|---|---|
| Rome D (naphthalene sulfonic acid soda salt manufactured by Sannopuko) | 1.5 parts |
| Ion exchanged water | 81.5 parts |
| Ethylene glycol | 5 parts |

The foregoing components were mixed, and then heated at 70° C. in water a bath so that the resin component was dissolved completely. Then, 11 parts of newly prepared carbon black (S170 manufactured by Degussa) and 1 part of isopropyl alcohol were added to the resin solution, and then pre-mixed for 60 minutes. Then, a dispersing process was performed under the following conditions:

| | |
|---|---|
| Dispersing machine: | sand grinder (manufactured by Igarashi) |
| Crushing medium: | zirconium beads having a diameter of 0.5 mm |
| Charge ratio of crushing medium: | 70% (volume) |
| Time in which crushing is performed: | 10 hours |

Further, centrifugal separation (12000 RPM for 20 minutes) was performed to remove coarse and large particles, to complete the preparation of the dispersant solution.

| | |
|---|---|
| Dispersant solution | 10 parts |
| Glycerine | 12 parts |
| Diethylene glycol | 15 parts |
| 2-pyrrolidone | 5 parts |
| Isopropyl alcohol | 3 parts |
| Ion exchanged water | 55 parts |

The components were mixed together, and then the pH of the mixture was adjusted to 8 to 10 with monoethanol amine to form ink (C).

Making of Recorded Product

Several recorded images were prepared employing various combinations of a first-supplied fluid (fluids (a) to (d) above) with an ink composition (Inks (A) to (C)). The images were prepared using recording apparatus with the head configurations specified below in the paragraphs numbered (1), (2) and (3).

(1) On-demand ink jet cartridges are arranged to form two lines as shown in FIG. 5 in such a manner that the fluid to be supplied first is charged in the cartridge that first jets the fluid and ink was charged in the residual cartridge. Recording was performed to evaluate various aspects of image quality. The results are shown in Table 1.

(2) A recording apparatus as shown in FIG. 2 and having two on-demand recording heads each including a piezoelectric oscillator was used. The fluid to be supplied first and the ink were charged in the respective ink tanks, and recording was performed to evaluate the image properties.

(3) Prior to performing the recording operation with the ink jet recording apparatus, the recording paper was, by a spraying method, processed with the fluid to be supplied first. Then, the prepared ink was charged in the recording head of Bubble Jet Printer BJ-10v (manufactured by Canon), and recording was performed to evaluate the same properties as evaluated for images produced by apparatuses (1) and (2).

The combinations of ink, the fluid to be supplied first, and the method of making the recorded product according to the embodiments of the present invention are shown in Table 1.

Evaluation 1

The foregoing ink jet recording apparatus was used to record data on a copying paper sheet Xerox 4024 and Canon NP-DRY and the density of the recorded image was measured by a Macbeth density meter (TR918).

Evaluation 2

Light Resistance, Water Resistance and Abrasion Resistance

The foregoing recorded product was dipped in ordinary tap water for 5 minutes, the density of the image before and after the test was measured, the residual ratio of the image density was calculated and the average value of the two paper sheets was employed as the water resistance of the printed product.

The foregoing recording product was irradiated with light by using an Atlas Fade Meter for 200 hours, the image density before and after the test was measured, the residual ratio of the image density was calculated, and the average value of the two paper sheets was employed as the light resistance of the printed product.

After 5 minutes had passed from the recording operation, the recorded product was rubbed with the finger and the results were evaluated such that a state where no ink adhered to the finger was evaluated as "○", a state where a slight amount of ink adhered to the finger was evaluated as "Δ" and a state where an appreciable amount of ink adhered was evaluated as "x".

COMPARATIVE EXAMPLES 1, 2, 3 AND 4

A recording apparatus having only an ink jet cartridge for supplying ink was used to evaluate image quality by using the ink compositions according to Examples 1 to 4. Comparative Examples 1, 2, 3 and 4 correspond to Examples 1 to 4, respectively, only being modified therefrom as specified in Table 1.

COMPARATIVE EXAMPLE 5

(Preparation of Ink (D)

| | |
|---|---|
| C1. Hood Black 2 | 3 parts |
| Glycerine | 8 parts |
| Ethylene glycol | 5 parts |
| Ethanol | 5 parts |
| Ion exchanged water | 79 parts |

The foregoing components were mixed, and aminomethyl propanol was used to adjust the pH of the mixture to 8 to 10 so that ink (D) was obtained. By using ink (D) and the above fluid (a) to be first supplied, recorded images were made for evaluation similar to Examples 1 to 4.

Table 1 shows the results for the examples according to the present invention and for the comparative examples.

TABLE 1

Results of Tests

| | Ink | Fluid to be supplied first | Method of making recorded product | Evaluation 1 Image density Xerox 4024 | Evaluation 1 Image density NP-DRY | Evaluation 2 Water resistance (%) | Evaluation 2 Light resistance (%) | Evaluation 2 Abrasion Resistance |
|---|---|---|---|---|---|---|---|---|
| Example 1 | (A) | (a) | (1) | 1.29 | 1.31 | 98 | 100 | ○ |
| | (A) | (b) | | 1.28 | 1.32 | 99 | 98 | ○ |
| | (A) | (c) | | 1.30 | 1.34 | 100 | 99 | Δ |
| | (A) | (d) | | 1.25 | 1.28 | 100 | 100 | ○ |
| Example 2 | (B) | (a) | (2) | 1.29 | 1.31 | 99 | 100 | ○ |
| | (B) | (b) | | 1.30 | 1.35 | 100 | 99 | Δ |
| | (B) | (c) | | 1.33 | 1.36 | 98 | 97 | ○ |
| | (B) | (d) | | 1.29 | 1.31 | 99 | 100 | ○ |
| Example 3 | (B) | (a) | (3) | 1.30 | 1.31 | 97 | 99 | ○ |
| | (B) | (b) | | 1.28 | 1.33 | 100 | 100 | ○ |
| | (B) | (c) | | 1.33 | 1.35 | 100 | 97 | |
| | (B) | (d) | | 1.26 | 1.29 | 98 | 99 | ○ |

TABLE 1-continued

| | | | | Results of Tests | | | | |
|---|---|---|---|---|---|---|---|---|
| | | Fluid | Method | | | Evaluation 2 | | |
| | | to be supplied | of making recorded | Evaluation 1 Image density | | Water resistance | Light resistance | Abrasion |
| | Ink | first | product | Xerox 4024 | NP-DRY | (%) | (%) | Resistance |
| Example 4 | (C) | (a) | (1) | 1.28 | 1.30 | 97 | 98 | Δ |
| | (C) | (b) | | 1.25 | 1.25 | 98 | 100 | o |
| | (C) | (c) | | 1.28 | 1.31 | 99 | 98 | o |
| | (C) | (d) | | 1.25 | 1.26 | 100 | 98 | o |
| Comparative Example 1 | (A) | No fluid | (1) however only head for ink | 0.98 | 1.18 | 100 | 100 | x |
| Comparative Example 2 | (B) | No fluid | (2) however only head for ink | 0.97 | 1.17 | 100 | 99 | x |
| Comparative Example 3 | (B) | No fluid | (3) no spray supply | 0.97 | 1.18 | 100 | 98 | x |
| Comparative Example 4 | (C) | No fluid | (1) however only head for ink | 0.80 | 0.84 | 100 | 97 | x |
| Comparative Example 5 | (D) | (a) | (1) | 1.30 | 1.32 | 45 | 85 | o |

EXAMPLES 5 TO 8

(1) Preparation of Fluids (f) to (i) to be Supplied First.

Fluid (f) was composed as follows:

| | |
|---|---|
| Nippemicrojell E-3101 (styrene-acryl copolymer manufactured by Nihon Paint which has a particle size of about 0.3 μm and which is a 19.7%-water dispersant) | 5 parts |
| Glycerine | 10 parts |
| Ethyl alcohol | 3.5 parts |
| Ion exchanged water | 81.5 parts |

The foregoing materials were weighed precisely and mixed, and then stirred and dispersed with ultrasonic waves for one hour to form fluid (f).

Similarly, fluid (g), prepared by the same method as that for preparing fluid (f), had the following composition:

| | |
|---|---|
| ME1000CF (polymethylmethacrylate manufactured by Soken, having a particle size of about 0.4 μm and 40%-water dispersant) | 20 parts |
| Ethylene glycol | 30 parts |
| Ion exchanged water | 50 parts |

Fluid (h), prepared by the same method as that for preparing fluid (f), had the following composition:

| | |
|---|---|
| Titania IT-S (surface hydrophilic titanium dioxide manufactured by Idemitsu and having a particle size of about 0.2 μm and 100% powder) | 1 part |
| Thiodiglycol | 30 parts |
| Acetylenol EH (manufactured by Kawaken) | 0.5 part |
| Ion exchanged water | 68.5 parts |

Fluid (i), prepared by the same method as that for preparing fluid (f), had the following composition:

| | |
|---|---|
| Tospearl 103 (silicon resin manufactured by Toshiba Silicon and having a particle size of about 0.3 μm and 100% powder) | 1.5 parts |
| Glycerine | 10 parts |
| Ethyl alcohol | 10 parts |
| Emalgen 913 (manufactured by Kao) | 0.5 part |
| Ion exchanged water | 78 parts |

(2) Preparation of Ink (A) to (C)

The inks (A) to (C) prepared in Examples 1, 2, 3 and 4 were used.

Similar to Examples 1 to 4, recording was performed and the recorded images evaluated. The results are shown in Table 2.

TABLE 2

| | Recording Fluid | Fluid to be supplied first | Method of making recorded product | Evaluation 1 Image density Xerox 4024 | Evaluation 1 Image density NP-DRY | Evaluation 2 Water resistance (%) | Evaluation 2 Light resistance (%) |
|---|---|---|---|---|---|---|---|
| Example 5 | (A) | (f) | (1) | 1.27 | 1.30 | 99 | 100 |
| | (A) | (g) | | 1.27 | 1.32 | 100 | 99 |
| | (A) | (h) | | 1.31 | 1.34 | 98 | 98 |
| | (A) | (i) | | 1.26 | 1.29 | 100 | 100 |
| Example 6 | (B) | (f) | (2) | 1.30 | 1.31 | 99 | 99 |
| | (B) | (g) | | 1.29 | 1.34 | 100 | 100 |
| | (B) | (h) | | 1.34 | 1.38 | 99 | 98 |
| | (B) | (i) | | 1.27 | 1.32 | 100 | 100 |
| Example 7 | (B) | (f) | (3) | 1.30 | 1.29 | 97 | 100 |
| | (B) | (g) | | 1.29 | 1.32 | 99 | 99 |
| | (B) | (h) | | 1.32 | 1.35 | 100 | 98 |
| | (B) | (i) | | 1.25 | 1.28 | 99 | 100 |
| Example 8 | (C) | (f) | (1) | 1.28 | 1.29 | 100 | 99 |
| | (C) | (g) | | 1.25 | 1.26 | 97 | 100 |
| | (C) | (h) | | 1.28 | 1.31 | 98 | 99 |
| | (C) | (i) | | 1.24 | 1.25 | 99 | 98 |

EXAMPLES 9 TO 12

(1) Preparation of Fluid (k) to (m) to be Supplied First

Fluid (k) to be supplied first had the following composition:

| | |
|---|---|
| Glycerine | 10 parts |
| Ethyl alcohol | 3.5 parts |
| Polyvinyl pyrrolidone PVPK-60 (manufactured by G.A.F) | 3 parts |
| Ion exchanged water | 83.5 parts |

The foregoing materials were weighed precisely and mixed in 60° C.-water bath, then stirred and dispersed with ultrasonic waves for one hour to form fluid (k).

Similarly, fluid (1) was prepared by the same method as that for preparing fluid (k) and had the following composition:

| | |
|---|---|
| Ethylene glycol | 30 parts |
| Cation PVA C-318AA (trial product manufactured by Kurare) | 2 part |
| Ion exchanged water | 68 parts |

Fluid (m) was prepared by the same method as that for preparing fluid (k and had the following composition:

| | |
|---|---|
| Thiodiglycol | 30 parts |
| Styrene-acrylic acid copolymer (acid value: 350, weight average molecular weight: 12000) | 3 parts |
| Sodium chloride | 2 parts |
| Ion exchanged water | 67 parts |

(2) Preparation of Inks E to G

| Ink E | |
|---|---|
| Styrene-acrylic acid-butyl acrylate copolymer (acid value: 116, weight average molecular weight: 3700) | 1.5 parts |
| Monoethanol amine | 1 part |

-continued

| Ink E | |
|---|---|
| Ion exchanged water | 81.5 parts |
| Diethylene glycol | 5 parts |

The foregoing components were mixed and heated to 70° C. in a water bath to dissolve the resin component completely. Then, 10 parts of carbon black (MCF88 manufactured by Mitsubishi Kasei) and 1 part of isopropyl alcohol were added to the resin solution, being pre-mixed for 30 minutes. Next, a dispersant process was performed under the following conditions:

| | |
|---|---|
| Dispersing machine: | sand grinder (manufactured by Igarashi) |
| Crushing medium: | zirconium beads having a diameter of 1 mm |
| Charge ratio of crushing medium: | 50% (volume) |
| Time in which crushing is performed: | 3 hours |

Further, centrifugal separation (12000 RPM for 20 minutes) was performed to remove coarse and large particles, to complete the preparation of the dispersant solution. The dispersant solution containing the pigment was then combined with the following components in the quantities specified:

| | |
|---|---|
| Dispersant solution | 10 parts |
| Glycerine | 2 parts |
| Diethylene glycol | 15 parts |
| N-methyl pyrrolidone | 5 parts |
| Isopropyl alcohol | 3 parts |
| Ion exchanged water | 65 parts |

The foregoing components were mixed to form ink (E).

| INK F | |
|---|---|
| Solsperth 20000 (cation dispersant manufactured by I.C.I) | 8 parts |

-continued

| INK F | |
|---|---|
| Solsperth 12000 (cation dispersant manufactured by I.C.I) | 2 parts |
| Ion exchanged water | 70 parts |
| Diethylene glycol | 5 parts |

The foregoing components were mixed, and then heated at 70° C. in a water bath so that the resin component was dissolved completely. Then, 15 parts of carbon black (Mogal L manufactured by Degussa) were added to the solution, and then pre-mixed for 30 minutes. Then, a dispersing process was performed under the following conditions:

| | |
|---|---|
| Dispersing machine: | Pearl Mill (manufactured by Ashizawa) |
| Crushing medium: | glass beads having a diameter of 1 mm |
| Charge ratio of crushing medium: | 50% (volume) |
| Discharging speed: | 100 ml/min. |

Further, centrifugal separation (12000 RPM for 20 minutes). was performed to remove coarse and large particles, to complete the preparation of the dispersant solution.

The dispersant solution containing the pigment was then combined with the following components in the quantities specified:

| | |
|---|---|
| Dispersant solution | 20 parts |
| Glycerine | 8 parts |
| Ethylene glycol | 5 parts |
| Ethanol | 5 parts |
| Ion exchanged water | 61.5 parts |

Thus, ink (F) was obtained.

| INK G | |
|---|---|
| Rome D (naphthalene sulfonic acid soda salt manufactured by Sannopuko) | 1.5 parts |
| Ion exchanged water | 81.5 parts |
| Ethylene glycol | 5 parts |

The foregoing components were mixed, and then heated at 70° C. in a water bath so that the resin component was dissolved completely. Then, 11 parts of newly prepared carbon black (S170 manufactured by Degussa) and 1 part of isopropyl alcohol were added to the resin solution, and then pre-mixed for 60 minutes. Then, a dispersing process was performed under the following conditions:

| | |
|---|---|
| Dispersing machine: | sand grinder (manufactured by Igarashi) |
| Crushing medium: | zirconium beads having a diameter of 0.5 mm |
| Charge ratio of crushing medium: | 70% (volume) |
| Time in which crushing is performed: | 10 hours |

Further, centrifugal separation (12000 RPM for 20 minutes) was performed to remove coarse and large particles, to complete the preparation of the dispersant solution.

The dispersant solution containing the pigment was then combined with the following components in the quantities specified:

| | |
|---|---|
| Dispersant solution | 10 parts |
| Glycerine | 12 parts |
| Diethylene glycol | 15 parts |
| 2-pyrrolidone | 5 parts |
| Isopropyl alcohol | 3 parts |
| Ion exchanged water | 55 parts |

The foregoing components were mixed to obtain Ink (G).

Recording tests were performed with each of examples 9 to 12. The results are as shown in Table 3.

COMPARATIVE EXAMPLES 6 TO 9

The recording apparatus having the ink jet cartridge for jetting ink was used to evaluate the ink according to Examples 9 to 12, in a manner similar to Comparative Examples 1 to 4.

COMPARATIVE EXAMPLE 10

Ink (D) and fluid (k), to be supplied first, were used to conduct a test similar to Examples 1 to 4. The comparative test results are shown in Table 3.

TABLE 3

| | | | | Results of Tests | | | | |
|---|---|---|---|---|---|---|---|---|
| | | | | | | Evaluation 2 | | |
| | | Fluid to be supplied | Method of making recorded | Evaluation 1 Image density | | Water resistance | Light resistance | Abrasion |
| | Ink | first | product | Xerox 4024 | NP-DRY | (%) | (%) | Resistance |
| Example 9 | (E) | (k) | (1) | 1.35 | 1.35 | 99 | 100 | o |
| | (E) | (1) | | 1.34 | 1.32 | 100 | 98 | o |
| Example 10 | (F) | (m) | (2) | 1.22 | 1.23 | 99 | 99 | o |
| Example 11 | (G) | (k) | (3) | 1.31 | 1.31 | 98 | 100 | o |
| | (G) | (1) | | 1.29 | 1.33 | 99 | 99 | o |
| Example 12 | (E) | (k) | (2) | 1.35 | 1.31 | 100 | 99 | o |
| | (E) | (1) | | 1.34 | 1.30 | 98 | 98 | o |
| Comparative Example 6 | (E) | No fluid | (1) | 0.98 | 1.18 | 100 | 100 | x |

TABLE 3-continued

| | | Fluid to be supplied first | Method of making recorded product | Results of Tests: Evaluation 1 Image density Xerox 4024 | NP-DRY | Evaluation 2 Water resistance (%) | Light resistance (%) | Abrasion Resistance |
|---|---|---|---|---|---|---|---|---|
| Comparative Example 7 | (F) | No fluid | (2) | 0.84 | 1.05 | 100 | 98 | x |
| Comparative Example 8 | (G) | No fluid | (3) | 0.97 | 1.18 | 100 | 98 | x |
| Comparative Example 9 | (E) | No fluid | (2) | 0.80 | 0.84 | 100 | 97 | x |
| Comparative Example 10 | (D) | (k) | (1) | 1.30 | 1.32 | 65 | 83 | ○ |

EXAMPLES 13 TO 16

(1) Preparation of Fluid (p) to (r) to be Supplied First or Second

Fluid (p):

| | |
|---|---|
| Hydrochloric acid | 0.35 parts |
| Ethyl alcohol | 10 parts |
| Acetylenol EH (Kawaken) | 0.5 part |
| Ion exchanged water | 85.65 parts |

The foregoing components were precisely weighed, stirred for one hour, and filtered under pressure using a 0.22μ fluoro-pore filter to obtain fluid (p).

Similarly, fluid (q), prepared by the same method as that for preparing fluid (p), had the following composition:

| | |
|---|---|
| Carbonic acid | 0.6 part |
| Ethylene glycol | 30 parts |
| Noigen EA-126 (Daiichi) | 1 part |
| Ion exchanged water | 68.4 parts |

Fluid (r), prepared by the same method as that for preparing fluid (p), had the following composition:

| | |
|---|---|
| Acetic acid | 0.6 part |
| Thiodiglycol | 30 parts |
| Surfinol 465 (Nissin) | 0.5 part |
| Ion exchanged water | 68.9 parts |

(2) Preparation of Inks (H) to (J)

| | |
|---|---|
| Styrene-acrylic acid-butyl acrylate copolymer (acid value: 116, weight average molecular weight: 3700) | 1.5 parts |
| Monoethanol amine | 1 part |
| Ion exchanged water | 81.5 parts |
| Diethylene glycol | 5 parts |

The foregoing components were mixed and heated to 70° C. in water bath to dissolve the resin component completely. Then, 10 parts of new trial product, carbon black (MCF88 manufactured by Mitsubishi Kasei) and 1 part of isopropyl alcohol were added to the resin solution, and pre-mixed for 30 minutes and a dispersant process was performed under the following conditions:

| | |
|---|---|
| Dispersing machine: | sand grinder (manufactured by Igarashi) |
| Crushing medium: | zirconium beads having a diameter of 1 mm |
| Charge ratio of crushing medium: | 50% (volume) |
| Time in which crushing is performed: | 3 hours |

Further, centrifugal separation (12000 RPM for 20 minutes) was performed to remove coarse and large particles, to complete the preparation of the dispersant solution.

The dispersant solution containing the pigment was then combined with the following components in the quantities specified:

| | |
|---|---|
| Dispersant solution | 10 parts |
| Glycerine | 2 parts |
| Diethylene glycol | 15 parts |
| N-methyl pyrrolidone | 5 parts |
| Isopropyl alcohol | 3 parts |
| Ion exchanged water | 65 parts |

The foregoing components were mixed and the pH of the mixture was adjusted to 8 to 10 with monoethanol amine to obtain ink (H).

| | |
|---|---|
| Styrene-maleic acid-maleic acid half ester copolymer (acid value: 200 and weight average molecular weight: 12000) | 4 parts |
| Aminomethyl propanol | 2 parts |
| Ion exchanged water | 74 parts |
| Diethylene glycol | 5 parts |

The foregoing components were mixed, and then heated at 70° C. in water bath so that the resin component was dissolved completely. Then, 15 parts of carbon black (MCF88 manufactured by Mitsubishi Kasei) were added to the resin solution, and then pre-mixed for 30 minutes. Then, a dispersing process was performed under the following conditions:

| | |
|---|---|
| Dispersing machine: | Pearl Mill (manufactured by Ashizawa) |
| Crushing medium: | glass beads having a diameter of 1 mm |

-continued

| | |
|---|---|
| Charge ratio of crushing medium: | 50% (volume) |
| Discharging speed: | 100 ml/min. |

Further, centrifugal separation (12000 RPM for 20 minutes) was performed to remove coarse and large particles, to complete the preparation of the dispersant solution.

The dispersant solution containing the pigment was then combined with the following components in the quantities specified:

| | |
|---|---|
| Dispersant solution | 20 parts |
| Glycerine | 8 parts |
| Ethylene glycol | 5 parts |
| Ethanol | 5 parts |
| Ion exchanged water | 61.5 parts |

The foregoing components were mixed, and then the pH of the mixture was adjusted to 8 to 10 with aminomethyl propanol to obtain ink (I).

| | |
|---|---|
| Demol N | 1.5 parts |
| Ion exchanged water | 81.5 parts |
| Ethylene glycol | 5 parts |

The foregoing components were mixed, and then heated at 70° C. in a water bath so that the resin component was dissolved completely. Then, 11 parts of newly prepared carbon black (S170 manufactured by Degussa) and 1 part of isopropyl alcohol were added to the resin solution, and then pre-mixed for 60 minutes. Then, a dispersing process was performed under the following conditions:

| | |
|---|---|
| Dispersing machine: | sand grinder (manufactured by Igarashi) |
| Crushing medium: | zirconium beads having a diameter of 0.5 mm |
| Charge ratio of crushing medium: | 70% (volume) |
| Time in which crushing is performed: | 10 hours |

Further, centrifugal separation (12000 RPM for 20 minutes) was performed to remove coarse and large particles, to complete the preparation of the dispersant solution.

The dispersant solution containing the pigment was then combined with the following components in the quantities specified:

| | |
|---|---|
| Dispersant solution | 10 parts |
| Glycerine | 12 parts |
| Diethylene glycol | 15 parts |
| 2-pyrrolidone | 5 parts |
| Isopropyl alcohol | 3 parts |
| Ion exchanged water | 55 parts |

The foregoing components were mixed, and then the pH of the mixture was adjusted to 8 to 10 by using monoethanol amine to obtain ink (J).

Preparation of Recorded Product

Several recorded images were prepared employing various combinations of a first-supplied fluid (fluids (p) to (r) above) with an ink composition (Inks (H) to (J)). The images were prepared using recording apparatus with the head configurations specified below in the paragraphs numbered (1), (2) and (3).

(1) On-demand ink jet cartridges are arranged to form two lines as shown in FIG. 5 in such a manner that the fluid to be supplied first or second is charged in the cartridge that first jets the fluid and ink was charged in the residual cartridge. Then, recording was performed to evaluate various aspects of image quality. The results are shown in Table 4.

(2) A recording apparatus as shown in FIG. 2 and having two on-demand recording heads each including a piezoelectric oscillator was used. Ink was charged into the head for supplying the fluid to be supplied first and the fluid to be supplied first or second was charged into the residual tank, and recording was performed to evaluate the image properties.

(3) Prior to performing the recording operation with the ink jet recording apparatus, the recording paper was, by a spraying method, processed with the foregoing fluid. Then, the prepared ink was charged in the recording head of Bubble Jet Printer BJ-10v (manufactured by Canon), and recording was performed to evaluate the same properties as evaluated for images produced by apparatuses (1) and (2):

Evaluation 1

Printing Density of Recorded Product

The foregoing ink jet recording apparatus was used, and recording on copying paper Xerox 4024 and on copying paper sheet Canon NP-DRY were performed to measure the density of each of the recorded images by using a Macbeth Density Meter (TR918).

Evaluation 2

Light Resistance, Water Resistance of Recorded Product

The foregoing recorded product was dipped in ordinary tap water for 5 minutes, the density of the image before and after the test was measured, the residual ratio of the image density was calculated and the average value of the two paper sheets was employed as the water resistance of the printed product.

The foregoing recording product was irradiated with light by using an Atlas Fade Meter for 200 hours, the image density before and after the test was measured, the residual ratio of the image density was calculated, and the average value of the two paper sheets was employed as the light resistance of the printed product.

The combinations of inks, the fluids and the methods of making the recorded products in the examples and the test results of the evaluations are shown in Table 4.

COMPARATIVE EXAMPLES 11 TO 14

A recording apparatus having only an ink jet cartridge for supplying ink was used to evaluate image quality by using the ink according to Examples 13 to 16. Comparative examples, 11, 12, 13 and 14 correspond to Examples 13, 14, 15 and 16, respectively, only being modified therefrom as specified in Table 4.

Ink (D) and fluid (p) were used to carry out evaluations similar to Examples 13 to 16. The results are shown in Table 4.

TABLE 4

| | Recording Fluid | Fluid to be supplied first or second | Method of making recorded product | Evaluation 1 Image density Xerox 4024 | Evaluation 1 Image density NP-DRY | Evaluation 2 Water resistance (%) | Evaluation 2 Light resistance (%) |
|---|---|---|---|---|---|---|---|
| Example 13 | (H) | (p) | (1) | 1.45 | 1.38 | 100 | 100 |
| | (H) | (q) | | 1.41 | 1.34 | 99 | 99 |
| | (H) | (r) | | 1.43 | 1.36 | 99 | 99 |
| Comparative Example 11 | (H) | no fluid | | 0.98 | 1.18 | 100 | 100 |
| Example 14 | (I) | (p) | (2) | 1.43 | 1.38 | 98 | 100 |
| | (I) | (q) | | 1.42 | 1.40 | 99 | 100 |
| | (I) | (r) | | 1.43 | 1.42 | 100 | 99 |
| Comparative Example 12 | (I) | no fluid | | 0.97 | 1.17 | 100 | 99 |
| Example 15 | (I) | (p) | (3) | 1.46 | 1.50 | 99 | 100 |
| | (I) | (q) | | 1.44 | 1.48 | 100 | 97 |
| | (I) | (r) | | 1.48 | 1.49 | 100 | 99 |
| Comparative Example 13 | (I) | no fluid | | 0.97 | 1.18 | 100 | 98 |
| Example 16 | (J) | (p) | (1) | 1.28 | 1.24 | 100 | 98 |
| | (J) | (q) | | 1.25 | 1.21 | 99 | 100 |
| | (J) | (r) | | 1.24 | 1.22 | 100 | 99 |
| Comparative Example 14 | (J) | no fluid | | 0.80 | 0.84 | 100 | 97 |
| Comparative Example 15 | (D) | (p) | (1) | 1.30 | 1.32 | 45 | 85 |

EXAMPLES 17 TO 20

(1) Preparation of Fluids (u) to (w) to be Supplied First or Second

Fluid (u) was prepared as follows:

| | |
|---|---|
| Styrene-acrylic acid-ethyl acrylate copolymer (acid value: 60 and molecular weight: 5600) | 4 parts |
| Monoethanol amine | 0.5 parts |
| Glycerine | 10 parts |
| Isopropyl alcohol | 3.5 parts |
| Acetylenol EH (Kawaken) | 0.5 part |
| Ion exchanged water | 81.5 parts |

The ion exchanged water and monoethanol amine were mixed in water bath, and the weighed resin was gradually added. The solution was stirred for one hour to dissolve the resin completely. The temperature was restored to the room temperature and the other components were added to the resin solution. A 0.22μ fluoro-pore filter was used to filter the mixture under pressure to obtain fluid (u).

Similarly, fluid (v) was prepared by the same method as that for preparing fluid (u) and had the following composition.

| | |
|---|---|
| α-methylstyrene-methacrylic acid-butyl methacrylate (acid value 85 and molecular weight 3700) | 5 parts |
| Aminomethyl propanol | 1.5 part |
| Ethylene glycol | 20 parts |
| Noigen EA-126 (Daiichi) | 1 part |
| Ion exchanged water | 72.5 parts |

Similarly, fluid (w) was prepared by the same method as that for preparing fluid (u) and had the following composition.

| | |
|---|---|
| Styrene-maleic acid half ester-maleic acid ammonium salt (acid value 40, molecular weight 7800) | 4 parts |
| Thiodiglycol | 15 parts |
| Surfinol 465 (Nisshin) | 0.5 part |
| Ion exchanged water | 80.5 part |

(2) Preparation of Ink

Inks (H) to (J) according to Examples 13 to 16 were used.

The recorded products were made and evaluated similar to Examples 13 to 16 and the results are shown in Table 5.

EXAMPLES 21 TO 24

(1) Preparation of Fluid (z) to (z3)

Fluid (z) was prepared as follows

| | |
|---|---|
| Sodium chloride | 5 parts |
| Glycerine | 10 parts |
| Ethyl alcohol | 3.5 parts |
| Acetylenol EH (Kawaken) | 0.5 part |
| Ion exchanged water | 81 parts |

TABLE 5

| | Recording Fluid | Fluid to be supplied first or second | Method of making recorded product | Evaluation 1 Image density Xerox 4024 | Evaluation 1 Image density NP-DRY | Evaluation 2 Water resistance (%) | Evaluation 2 Light resistance (%) |
|---|---|---|---|---|---|---|---|
| Example 17 | (H) | (u) | (1) | 1.28 | 1.30 | 100 | 100 |
| | (H) | (v) | | 1.25 | 1.28 | 100 | 99 |
| | (H) | (w) | | 1.30 | 1.31 | 100 | 98 |
| Example 18 | (I) | (u) | (2) | 1.29 | 1.26 | 97 | 100 |
| | (I) | (v) | | 1.25 | 1.28 | 98 | 100 |
| | (I) | (w) | | 1.31 | 1.35 | 98 | 98 |
| Example 19 | (I) | (u) | (3) | 1.28 | 1.28 | 99 | 100 |
| | (I) | (v) | | 1.28 | 1.28 | 99 | 100 |
| | (I) | (w) | | 1.27 | 1.29 | 99 | 100 |
| Example 20 | (J) | (u) | (1) | 1.25 | 1.25 | 100 | 99 |
| | (J) | (v) | | 1.24 | 1.21 | 98 | 98 |
| | (J) | (w) | | 1.25 | 1.23 | 100 | 97 |

The foregoing components were precisely weighed, stirred for one hour, and filtered under pressure by using a 0.22μ fluoro-pore filter, to obtain fluid (z) to be supplied first.

Similarly, fluid (Z2) having the following composition was prepared by the same method as that for preparing fluid (z):

| | |
|---|---|
| Calcium carbonate | 3 parts |
| Ethylene glycol | 30 parts |
| Noigen EA-126 (Daiichi) | 1 part |
| Ion exchanged water | 66 parts |

Fluid (z3) having the following composition was also prepared by the same method as that for preparing fluid (z):

| | |
|---|---|
| Lithium acetate | 7 parts |
| Thiodiglycol | 30 parts |
| Surfinol 465 (Nissin) | 0.5 part |
| Ion exchanged water | 62.5 parts |

(2) Preparation of Ink

Inks (H) to (J) according to Examples 13 to 16 were used.

The recorded products were made and evaluated similar to those of Examples 13 to 16, and the results are shown in Table 6.

EXAMPLES 25 TO 28

Preparation of Fluids (Z4) to (Z6)

| | |
|---|---|
| 0.1-mol water solution of tris-aminohydroxy methyl aminomethane | 25 parts |
| 0.1-mol water solution of hydrochloric acid | 5 parts |
| Glycerine | 10 parts |
| Ethyl alcohol | 3.5 parts |
| Acetylenol EH (Kawaken) | 0.5 part |
| Ion exchanged water | 61 parts |

The foregoing components were precisely weighed, stirred for one hour, and filtered under pressure by using a 0.22μ fluoro-pore filter to obtain fluid (z4). The resultant pH of the fluid was 6.5.

Similarly, fluid (Z5) having the following composition was prepared by the same method as that for preparing fluid (z4):

| | |
|---|---|
| 0.2-mol water solution of potassium hydride phthalate | 25 parts |
| 0.1-mol water solution of hydrochloric acid | 3 parts |
| Ethylene glycol | 30 parts |
| Noigen EA-126 (Daiichi) | 1 part |
| Ion exchanged water | 41 parts |

The pH of the fluid obtained was 3.8.

Similarly, fluid (z6) having the following composition was prepared by the same method as that for preparing fluid (z4):

| | |
|---|---|
| 0.1-mol water solution of potassium dihydrogen citrate | 25 parts |
| 0.1-mol water solution of sodium hydroxide | 1.5 parts |
| Thiodiglycol | 30 parts |
| Surfinol 465 (Nissin) | 0.5 part |
| Ion exchanged water | 43 parts |

The pH of the fluid obtained was 4.5.

(2) Preparation of Ink

Inks (H) to (J) according to Examples 13 to 16 were used.

The recorded products were made and evaluated similar to those of Examples 13 to 16. The results are shown in Table 7.

TABLE 6

| | Recording Fluid | Fluid to be supplied first or second | Method of making recorded product | Evaluation 1 Image density Xerox 4024 | Evaluation 1 Image density NP-DRY | Evaluation 2 Water resistance (%) | Evaluation 2 Light resistance (%) |
|---|---|---|---|---|---|---|---|
| Example 21 | (H) | (z) | (1) | 1.30 | 1.35 | 100 | 100 |
| | (H) | (z2) | | 1.32 | 1.32 | 100 | 99 |
| | (H) | (z3) | | 1.37 | 1.38 | 99 | 98 |
| Example 22 | (I) | (z) | (2) | 1.31 | 1.32 | 100 | 100 |
| | (I) | (z2) | | 1.28 | 1.31 | 97 | 100 |
| | (I) | (z3) | | 1.36 | 1.38 | 100 | 98 |
| Example 23 | (I) | (z) | (3) | 1.32 | 1.33 | 99 | 100 |
| | (I) | (z2) | | 1.32 | 1.31 | 99 | 100 |
| | (I) | (z3) | | 1.37 | 1.37 | 99 | 100 |
| Example 24 | (J) | (z) | (1) | 1.26 | 1.25 | 100 | 99 |
| | (J) | (z2) | | 1.24 | 1.23 | 98 | 98 |
| | (J) | (z3) | | 1.25 | 1.23 | 100 | 97 |

TABLE 7

| | Recording Fluid | Fluid to be supplied first or second | Method of making recorded product | Evaluation 1 Image density Xerox 4024 | Evaluation 1 Image density NP-DRY | Evaluation 2 Water resistance (%) | Evaluation 2 Light resistance (%) |
|---|---|---|---|---|---|---|---|
| Example 25 | (H) | (z4) | (1) | 1.20 | 1.28 | 100 | 100 |
| | (H) | (z5) | | 1.34 | 1.32 | 99 | 98 |
| | (H) | (z6) | | 1.36 | 1.35 | 99 | 99 |
| Example 26 | (I) | (z4) | (2) | 1.22 | 1.22 | 98 | 99 |
| | (I) | (z5) | | 1.27 | 1.31 | 100 | 99 |
| | (I) | (z6) | | 1.34 | 1.35 | 100 | 97 |
| Example 27 | (I) | (z4) | (3) | 1.24 | 1.28 | 99 | 99 |
| | (I) | (z5) | | 1.32 | 1.31 | 98 | 99 |
| | (I) | (z6) | | 1.37 | 1.37 | 99 | 100 |
| Example 28 | (J) | (z4) | (1) | 1.20 | 1.10 | 98 | 100 |
| | (J) | (z5) | | 1.25 | 1.22 | 98 | 98 |
| | (J) | (z6) | | 1.26 | 1.23 | 97 | 98 |

EXAMPLES 29 TO 33 AND COMPARATIVE EXAMPLES 16 TO 20

Fluid (a) according to Example 1 and to be supplied first and the ink (A) were used to record data on the following various recording members to evaluate the characteristics of the image recorded thereon. The following recording members have different characteristics as shown in Table 8.

TABLE 8

| Recording member | Stockigt Sizing Degree (second) | Smoothness (second) | Weight per area g/m$^2$ | Acidity |
|---|---|---|---|---|
| Hammermill #16 | 12 | 14 | 65 | acid |
| Ardor Bond | 44 | 17 | 72 | acid |
| Gilbert Bond | 30 | 6 | 64 | acid |
| Champion DC | 17 | 24 | 76 | acid |
| Xerox 4024 | 38 | 30 | 74 | neutral |

The results of evaluations are shown in Table 9.

TABLE 9

| | Member on which data will be recorded | Ink | Fluid to be supplied first | *1 Method of making recorded product | *2 Density of image | *3 Non-uniformity of image |
|---|---|---|---|---|---|---|
| Example 29 | Hammermill #16 | (A) | (a) | (1) | 1.33 | o |
| Comparative Example 16 | | | Not supplied | (1) however ink head only | 1.25 | x |
| Example 30 | Ardon Bond | (A) | (a) | (1) | 1.33 | o |
| Comparative Example 17 | | | Not supplied | (1) however ink head only | 1.25 | x |
| Example 31 | Gilbert Bond | (A) | (a) | (1) | 1.33 | o |
| Comparative Example 18 | | | Not supplied | (1) however ink head only | 1.25 | x |
| Example 32 | Champion DC | (A) | (a) | (1) | 1.33 | o |
| Comparative Example 19 | | | Not supplied | (1) however ink head only | 1.25 | x |
| Example 33 | Xerox 4024 | (A) | (a) | (1) | 1.33 | o |
| Comparative Example 20 | | | Not supplied | (1) however ink head only | 1.25 | x |

*1: The same making method as that according to Examples 1 to 4
*2: Data was recorded on each member and the density of the formed image was measured by the Macbeth Density Meter (TR918).
*3: Solid image was recorded on each recording member, and the presence of nonuniformity of the image was visually evaluated as follows:
○: free from nonuniformity
x: nonuniformity was observed Although the present invention has been described with respect to what is considered to be the preferred embodiments, it is understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed:

1. An ink jet recording method for performing a recording operation comprising the steps of:

discharging an ink droplet composed of ink containing a pigment, a water soluble resin for dispersing said pigment and water to a recording member, on which data is recorded; and supplying a solution containing at least one of particles and binder polymer on to said recording member prior to discharging said ink, wherein said solution reduces dispersion stability of said ink to generate aggregation of said ink.

2. An ink jet recording method according to claim 1, wherein said particles contain one or more materials selected from the group consisting of polystyrene, styrene-acryl copolymer, polymethyl methacrylate, melamine resin, epoxy resin, silicon resin, benzoguanamine resin, polyamide resin, fluorine resin, polymer obtained by emulsion-polymerization of α, β-unsaturated ethylene monomer, titanium dioxide particles, silica and alumina.

3. An ink jet recording method according to claim 1, wherein the particle size of said particles is 0.01 to 5 μm.

4. An ink jet recording method for performing a recording operation comprising the steps of:

discharging an ink droplet composed of an ink composition containing a pigment, a first polymer having a polarity for dispersing said pigment and water to a recording member, on which data is recorded; and supplying a solution containing a second polymer that has a polarity opposite the polarity of said first polymer contained in said ink composition, on to said recording member prior to discharging said ink, wherein said solution reduces dispersion stability of said ink to generate aggregation of said ink.

5. An ink jet recording method according to claim 4, wherein said second polymer contains one or more materials selected from the group consisting of N-vinyl pyrrolidone, N-vinyl piperidone, N-vinyl caprolactam, N-vinyl-morpholine, N-vinyl-2-oxazolidone, N-vinyl-5-methyl-2-oxazolidone, homo polymer of monomers of acryl amide, and copolymer of monomers of acryl amide with monomer that is not acryl amide.

6. An ink jet recording method for performing a recording operation comprising the steps of:

discharging an ink droplet composed of an ink composition containing a pigment, a water soluble resin for dispersing said pigment and water to a recording member, on which data is recorded; and supplying an aqueous solution containing acid on to said recording member prior to or after said ink is discharged, wherein said solution reduces dispersion stability of said ink to generate aggregation of said ink.

7. An ink jet recording method according to claim 6, wherein said acid contains one or more materials selected from the group consisting of hydrochloric acid, acetic acid, a compound having a carboxylic group, carbonic acid, sulfonic acid, a compound having a sulfonic acid group, nitric acid, phosphoric acid, a phosphoric compound, sulfurous acid and nitrous acid.

8. An ink jet recording method for performing a recording operation comprising the steps of:

discharging an ink droplet composed of an ink composition containing a pigment, a water soluble resin for dispersing said pigment and water to a recording member, on which data is recorded; and supplying an aqueous solution containing resin, having an acid value of 30 to 100 and soluble in alkali, on to said recording member prior to or after said ink is discharged, wherein said solution reduces dispersion stability of said ink to generate aggregation of said ink.

9. An ink jet recording method according to claim 8, wherein said resin having the acid value of 30 to 100 and soluble in an aqueous alkali solution contains at least one of a copolymer and a salt of one or more monomers selected from styrene, styrene derivative, vinyl naphthalene, vinyl naphthalene derivative, aliphatic alcohol ester of α, β-ethylene unsaturated carboxylic acid, acrylic acid, an acrylic acid derivative, maleic acid, a maleic acid derivative, itaconic acid, an itaconic acid derivative, fumaric acid and a fumaric acid derivative.

10. An ink jet recording method for performing a recording operation comprising the steps of:

discharging an ink droplet composed of an ink composition containing a pigment, a water soluble resin for dispersing said pigment and water to a recording member, on which data is recorded; and supplying a solution containing salt on to said recording member prior to or after said ink is discharged, wherein said solution reduces dispersion stability of said ink to generate aggregation of said ink.

11. An ink jet recording method according to claim 10, wherein said salt contains one or more materials selected from the group consisting of sodium chloride, potassium chloride, lithium chloride, ammonium chloride, calcium chloride, magnesium chloride, barium chloride, calcium carbonate, magnesium carbonate, barium carbonate, sodium carbonate, lithium carbonate, ammonium carbonate, sodium acetate, potassium acetate, lithium acetate, sodium sulfate, potassium sulfate and aluminum sulfate.

12. An ink jet recording method for performing a recording operation comprising the steps of:

discharging an ink droplet composed of an ink composition containing a pigment, a water soluble resin for dispersing said pigment and water to a recording member, on which data is recorded; and supplying a solution containing a buffer solution on to said recording member prior to or after said ink is discharged, wherein said solution reduces dispersion stability of said ink to generate aggregation of said ink.

13. An ink jet recording method according to claim 12, wherein said buffer solution contains one or more materials selected from the group consisting of Clark-Lubs's buffer solution, Sφrensen's buffer solution, Kolthoff's buffer solution, Michaelis's buffer solution, McIlvaine's buffer solution, Britton-Robinson's buffer solution, Carmody's buffer solution, Gomori's buffer solution and Bates-Bower's buffer solution.

14. An ink jet recording method according to any one of claims 1, 4, 6, 8, 10 or 12, wherein said ink jet recording method uses heat energy.

15. An ink jet recording method according to any one of claims 1, 4, 6, 8, 10 or 12, wherein the pH of said ink composition is from 7 to 10.

16. An ink jet recording apparatus that supplies energy to an ink composition to discharge said ink in the form of a droplet so that data is recorded on a recording member, said ink jet recording apparatus comprising:

a main head that discharges said ink composition containing a pigment, a water-soluble resin for dispersing said pigment and water; and a sub-head that discharges a solution containing at least one of particles and binder polymer prior to performing a recording operation with said main head, wherein said solution reduces dispersion stability of said ink to generate aggregation of said ink.

17. An ink jet recording apparatus according to claim 16, wherein said main head comprises an energy supply means.

18. An ink jet recording apparatus according to claim 17, wherein said energy supply means is heat generating.

19. An ink jet recording apparatus that supplies energy to an ink composition to discharge said ink composition in the form of a droplet so that data is recorded on a recorded member, said ink jet recording apparatus comprising:

a main head that discharges said ink composition containing a pigment, a first polymer that has a polarity for dispersing said pigment and water; and a sub-head that discharges a solution containing a second polymer that has a polarity opposite the polarity of said first polymer contained in said ink composition, wherein said solution reduces dispersion stability of said ink to generate aggregation of said ink.

20. An ink jet recording apparatus according to claim 19, wherein said main head comprises an energy supply means.

21. An ink jet recording apparatus according to claim 20, wherein said energy supply means is heat generating.

22. An ink jet recording apparatus that supplies energy to an ink composition to discharge said ink composition in the form of a droplet so that data is recorded on a recording member, said ink jet recording apparatus comprising:

A main head that discharges said ink composition containing a pigment, a water soluble resin for dispersing said pigment and water; and a sub-head that discharges an aqueous solution containing acid prior to or after said recording operation is performed with said main head, wherein said aqueous solution reduces dispersion stability of said ink to generate aggregation of said ink.

23. An ink jet recording apparatus according to claim 22, wherein said main head comprises an energy supply means.

24. An ink jet recording apparatus according to claim 23, wherein said energy supply means is heat generating.

25. An ink jet recording apparatus that supplies energy to an ink composition to discharge said ink composition in the form of a droplet so that data is recorded on a recorded medium, said ink jet recording apparatus comprising:

a main head that discharges said ink composition containing a pigment, a water soluble resin for dispersing said pigment and water; and a sub-head that discharges an aqueous solution containing a resin that has an acid number of 30 to 100 and that can be dissolved in alkali, prior to or after said recording operation is performed with said main head, wherein said aqueous solution reduces dispersion stability of said ink to generate aggregation of said ink.

26. An ink jet recording apparatus according to claim 25, wherein said main head comprises an energy supply means.

27. An ink jet recording apparatus according to claim 26, wherein said energy supply means is heat generating.

28. An ink jet recording apparatus that supplies energy to an ink composition to discharge said ink composition in the form of a droplet so that data is recorded on a recording medium, said ink jet recording apparatus comprising:

a main head that discharges said ink composition containing a pigment, a water soluble resin for dispersing said pigment and water; and a sub-head that discharges a solution containing salt prior to or after said recording operation is performed with said main head, wherein said solution reduces dispersion stability of said ink to generate aggregation of said ink.

29. An ink jet recording apparatus according to claim 28, wherein said main head comprises an energy supply means.

30. An ink jet recording apparatus according to claim 29, wherein said energy supply means is heat generating.

31. An ink jet recording apparatus that supplies energy to an ink composition to discharge said ink composition in the form of a droplet so that data is recorded on a recording medium, said ink jet recording apparatus comprising:

a main head that discharges said ink composition containing a pigment, a water soluble resin for dispersing said pigment and water; and a sub-head that discharges a solution containing a buffer solution prior to or after said recording operation is performed with said main head, wherein said solution reduces dispersion stability of said ink to generate aggregation of said ink.

32. An ink jet recording apparatus according to claim 31, wherein said main head comprises an energy supply means.

33. An ink jet recording apparatus according to claim 32, wherein said energy supply means is heat generating.

* * * * *

UNITED STATES PATENT AND TRADEMARK OFFICE

CERTIFICATE OF CORRECTION

PATENT NO. : 5,640,187 Page 1 of 4

DATED : June 17, 1997

INVENTOR(S) : AKIO KASHIWAZAKI, ET AL.

It is certified that error appears in the above-identified patent and that said Letters Patent is hereby corrected as shown below:

COLUMN 5

Line 53, "particles is coalesce" should read --coalesced particles is--.

COLUMN 10

Line 24, "array" should read --arrayed--.

COLUMN 11

Line 50, "maphthalene" should read --naphthalene-- and "napthaline" should read --naphthalene--.

UNITED STATES PATENT AND TRADEMARK OFFICE

CERTIFICATE OF CORRECTION

PATENT NO. : 5,640,187 Page 2 of 4

DATED : June 17, 1997

INVENTOR(S) : AKIO KASHIWAZAKI, ET AL.

It is certified that error appears in the above-identified patent and that said Letters Patent is hereby corrected as shown below:

COLUMN 16

Line 19, "numeral" should read --numeral 72--.

COLUMN 18

Line 12, "water" should read --a water--.
Line 50, "water " should read --a water--.

COLUMN 23

Line 45, "2 part" should read --2 parts--.
Line 38, "in 60°C.-water bath" should read --in a 60°C. water bath--.

UNITED STATES PATENT AND TRADEMARK OFFICE

CERTIFICATE OF CORRECTION

PATENT NO. : 5,640,187 Page 3 of 4

DATED : June 17, 1997

INVENTOR(S) : AKIO KASHIWAZAKI, ET AL.

It is certified that error appears in the above-identified patent and that said Letters Patent is hereby corrected as shown below:

COLUMN 27

Line 61, "water bath" should read --a water bath--.

COLUMN 28

Line 56, "water bath" should read --a water bath--.

COLUMN 30

Line 58, "examples," should read --Examples--.

COLUMN 31

Line 45, "water bath" should read --a water bath--.

UNITED STATES PATENT AND TRADEMARK OFFICE

CERTIFICATE OF CORRECTION

PATENT NO. : 5,640,187 Page 4 of 4

DATED : June 17, 1997

INVENTOR(S) : AKIO KASHIWAZAKI, ET AL.

It is certified that error appears in the above-identified patent and that said Letters Patent is hereby corrected as shown below:

COLUMN 38

Line 45, "monomer" should read --a monomer--.

Signed and Sealed this

Thirty-first Day of March, 1998

Bruce Lehman

*Attest:*

BRUCE LEHMAN

*Attesting Officer*

*Commissioner of Patents and Trademarks*